US010685828B2

(12) United States Patent
Mayor-Smith

(10) Patent No.: US 10,685,828 B2
(45) Date of Patent: Jun. 16, 2020

(54) MERCURY-FREE UV GAS DISCHARGE LAMP

(71) Applicant: Hanovia Limited, Slough (GB)

(72) Inventor: Ian Mayor-Smith, Slough (GB)

( * ) Notice: Subject to any disclaimer, the term of this patent is extended or adjusted under 35 U.S.C. 154(b) by 0 days.

(21) Appl. No.: 16/304,719

(22) PCT Filed: May 26, 2017

(86) PCT No.: PCT/GB2017/051511
§ 371 (c)(1),
(2) Date: Nov. 27, 2018

(87) PCT Pub. No.: WO2017/203282
PCT Pub. Date: Nov. 30, 2017

(65) Prior Publication Data

US 2019/0279859 A1 Sep. 12, 2019

(30) Foreign Application Priority Data

May 27, 2016 (GB) ..... 1609447.6

(51) Int. Cl.

| | |
|---|---|
| ***H01J 17/20*** | (2012.01) |
| ***H01J 61/12*** | (2006.01) |
| ***H01J 61/18*** | (2006.01) |
| ***H01J 61/82*** | (2006.01) |

(52) U.S. Cl.
CPC ..... *H01J 61/125* (2013.01); *H01J 61/18* (2013.01); *H01J 61/827* (2013.01)

(58) Field of Classification Search
None
See application file for complete search history.

(56) References Cited

U.S. PATENT DOCUMENTS 2,355,117 A * 8/1944 Smith ..... H01J 61/125 313/161
2,673,944 A * 3/1954 James ..... H01J 61/18 313/572
3,748,520 A * 7/1973 Silver ..... H01J 61/125 313/571
4,360,758 A * 11/1982 Thornton, Jr. ..... H01J 61/18 313/27
5,661,365 A 8/1997 Turner
(Continued)

FOREIGN PATENT DOCUMENTS

EP 1502485 2/2005
EP 1463091 1/2008
(Continued)

OTHER PUBLICATIONS

International Search Report and the Written Opinion dated Sep. 25, 2017 From the International Searching Authority Re. Application No. PCT/GB2017/051511. (17 Pages).
(Continued)

*Primary Examiner* — Vip Patel

(57) ABSTRACT

A mercury-free high-pressure metal-halide ultraviolet gas-discharge lamp comprising a primary filling of at least one of osmium, germanium and tellurium, and a secondary filling comprising at least one of tin, antimony, indium, tantalum and gold. In a preferred embodiment, the primary filling is TeI2 and the secondary filling is SbI3.

10 Claims, 18 Drawing Sheets

(56) References Cited

U.S. PATENT DOCUMENTS

| | | | | |
|---|---|---|---|---|
| 6,600,254 | B2 * | 7/2003 | Tu | H01J 61/35 313/25 |
| 6,770,896 | B2 | 8/2004 | Schriever | |
| 7,385,211 | B2 | 6/2008 | Derra et al. | |
| 2010/0301746 | A1 | 12/2010 | Koerber et al. | |
| 2014/0117848 | A1 * | 5/2014 | Meyer | H01J 61/125 313/643 |

FOREIGN PATENT DOCUMENTS

| | | |
|---|---|---|
| GB | 1552334 | 9/1979 |
| WO | WO 2008/048968 | 4/2008 |
| WO | WO 2016/193694 | 12/2016 |
| WO | WO 2017/203282 | 11/2017 |

OTHER PUBLICATIONS

Patents Act 1977: Search Report Under Section 17(5) dated Oct. 12, 2016 From the Intellectual Property Office of the United Kingdom of Great Britain Re. Application No. GB1609447.6. (3 Pages).

Patents Act 1977: Search Report Under Section 17(5) dated Aug. 22, 2017 From the Intellectual Property Office of the United Kingdom of Great Britain Re. Application No. GB1708486.4. (3 Pages).

* cited by examiner

Images From Benchmark Mercury Lamps

Images From First Set of Halide Prototypes

Images From Second Set of Halide Prototypes

Images From Third Set of Halide Prototypes

MERCURY-FREE UV GAS DISCHARGE LAMP

RELATED APPLICATIONS

This application is a National Phase of PCT Patent Application No. PCT/GB2017/051511 having International filing date of May 26, 2017, which claims the benefit of priority of United Kingdom Patent Application No. 1609447.6 filed on May 27, 2016. The contents of the above applications are all incorporated by reference as if fully set forth herein in their entirety.

FIELD AND BACKGROUND OF THE INVENTION

This invention relates to gas-discharge lamps that produce electromagnetic radiation in the ultra-violet region of the electromagnetic spectrum. Such lamps may find use in various applications relating to disinfection, such as for the purification of water or treatment of food and beverages, in the manufacture of pharmaceuticals and also for curing and drying. More specifically, the invention relates to a mercury-free gas-discharge lamp and, in particular, a mercury-free radiation source for a gas-discharge lamp.

In a typical gas-discharge lamp, ultra-violet (UV) light is generated by passing an electrical discharge through an ionised gas (or "plasma"), as a consequence of the resulting transitions of electrons between energy states emitting photons of particular energies.

The use of ultra-violet (UV) electromagnetic radiation or light for disinfection and purification purposes is known. The most desirable wavelengths of UV radiation for disinfection purposes are generally understood to be in the 180 nm to 320 nm range, more preferably 200 nm to 300 nm (often referred to as UV-C), and optimally around 265 nm. UV radiation of such wavelengths has both a biological effect, inactivating (if only temporarily) micro-organisms primarily by genomic damage preventing replication, and a chemical effect, breaking chemical bonds (including those of micro-pollutants) by a process called photodissociation or photolysis.

UV electromagnetic radiation, typically of slightly higher wavelengths (up to approximately 400 nm), is also used for curing and drying.

Conventional UV gas-discharge lamps comprise an elongate tube of quartz or silica with electrodes at either end. The lamps are filled with a starting gas, typically a noble gas such as argon or xenon, and also a small quantity of radiating working material, typically mercury. At room temperature most of the mercury inside the lamp is in liquid form. The lamp is ignited by passing an electrical current across the electrodes of the lamp, which ionises the starting gas, the resulting atomic/electron collisions causing the mercury to evaporate. Once the lamp has reached operating condition, the mercury partial pressure is much higher than that of the starting gas, and mercury therefore dominates the electrical and radiating behaviour of the lamp.

There follows a short overview of high-pressure, low-pressure and metal-halide discharge lamps.

Overview of UV Sources

The development of sources of UV radiation is entwined with the development of sources of Electromagnetic Radiation (ER) in the visible spectrum i.e. visible lighting. These associations are not only in respect to the same fundamental principles of physics and design but practically as well. A key example being that of the low-pressure mercury (LP Hg) lamp which is essentially identical to that of a fluorescent lamp used commonly for residential lighting except for the addition of a phosphor coating which absorbs the UV atomic emission of mercury, and then subsequently emits in the visible region. As visible lighting consumes approximately 25% of the worlds produced electrical energy the goals for increased efficiency and extended lifetimes of visible ER sources are also aligned providing potential insight into an alternative method of UV ER generation. Sources of UV radiation are investigated and discussed below, however particular focus has been given to plasma sources, because of their current dominance of the market. Emerging sources and their impacts are also discussed.

Plasma UV Radiation Sources

Plasma lamps achieved commercial success in the 1930's following on from the incandescent lamp, where an incandescent lamp emits ER from a hot body e.g. a tungsten wire.

A plasma lamp (plasma being defined for example as "a gaseous mixture of positive ions and electrons") provides several benefits over an incandescent lamp. Firstly, radiation is produced with increased energy efficiency (i.e. the ratio of energy output to energy input). Secondly, as plasma-derived photons are produced from direct atomic excitation, their wavelengths are determined by the atomic constituents of the plasma, thus enabling the production of UV radiation. A number of methods have been developed to use plasma to produce UV radiation. The historically most successful methods are summarised below (physical characteristics such as lamp size, electrode design etc can vary considerably depending on the plasma characteristics, however these are not discussed. Instead focus is given to the variation in plasma characteristics):

Low Pressure (LP) Discharge Lamps

To produce suitable lamp plasma for use in UV disinfection an element or compound, the following characteristics must be achieved:

- Relatively low ionization energy whilst having an excitation energy to produce resonance ER at desirable wavelengths
- Sufficient vapour pressure to produce optimal internal lamp pressures whilst having a low enough boiling temperature to be in gas/vapour phase whilst at lamp operating temperatures
- Chemically inert to lamp materials i.e. electrodes and lamp envelope Mercury (Hg) meets these criteria and hence is the primary constituent of the majority of lamp plasmas for both visible lighting and UV disinfection. Although other elements can be and are used in limited quantities e.g. xenon, practical challenges include high internal lamp pressure creating problems when starting the lamp, and high running currents. Lamp pressures for compact Xenon lamps being in the region of 15 atm cold and up to 60 atm when running with the relevant temperature increase.

The Low Pressure (LP) Hg plasma discharge lamp is composed of a low internal Hg gas pressure (approximately 0.01 mbar) combined with a buffer gas that is usually argon. The low Hg pressure ensures that the majority of electron excitations are at two energy transitions producing 253.7 nm and 185.0 nm. The Hg pressure (and therefore the impedance and consequentially the lamp power) is determined by the running temperature of the lamp (increasing temperature meaning increasing pressure) and regulating the amount of Hg in the gas phase to that condensed on the cold spot, as shown in FIG. 1. The cold spot is the coldest point in the lamp and as such the point at which mercury will condense. More commonly, the practice of using a mercury amalgam (such as with bismuth or indium) enables better regulation of Hg in the gas phase (i.e. better stability) and enables an increase in power density, although secondary implications of this are a reduction in radiant efficiency in part due to the absorbance of resonance emission.

FIG. 1 shows a diagrammatic representation of key features of a Low Pressure mercury discharge lamp.

With the optimal selection of lamp variables (i.e. lamp geometry, Hg content, temperature etc.) an energy efficiency of 60% at 253.7 nm can be achieved, however this is only at low power densities (<0.5 W/cm approx. 0.2-0.3 W/cm at 253.7 nm); increasing power densities by up to 400% with the use of an amalgam and increasing tube diameter (in the region of 26-33 mm) will reduce the lamp efficiency to the region of 36% at 253.7 nm. Even at the highest efficiency, 40% losses are incurred which can be attributed to: the production of other wavelengths (3%), losses at the electrodes (15%) and elastic collisions with the tube wall and argon (22%). With such a temperature sensitive design, a limitation can be the temperature of the surrounding water, which, if at 4° C., would reduce the radiant efficiency to approximately 20%.

The development trend in LP discharges is to increase power density whilst maintaining radiant efficiency. In addition to the adoption of amalgam as previously described, the selection of the lamp driver is critical and further efficiencies have been gained by the use of a high frequency driver with a square wave. During the mid-1970's the concept of active heat regulation of the lamp through heating of the cathode and external heating of the lamp was employed, enabling optimised lamp conditions and therefore increased power densities (in part due to a reduction of re-absorption through line broadening). This concept has recently been reapplied to provide an increased output for UV disinfection reiterating the desire for a high radiant efficiency and high power density UV source. Further developments in lamp driver electronics have seen the use of inductively coupled fluorescent lamps and are proposed as a future solution to enable further continuing improvement of the LP plasma lamp, by reducing net losses and extending lamp life by removing the need for electrodes.

High Pressure (HP) Discharge Lamps

The basic requirements for a High Pressure (HP)—a term which includes High Intensity Discharge (HID)—in terms of lamp fillings are the same as that of the LP discharge, and hence Hg is again the most commonly used filling. In contrast however, the amount of Hg (and hence consequentially the internal pressure) is significantly higher than that of a LP discharge and as a key distinction to that of the LP discharge, all the Hg is in the vapour phase. This is shown in FIG. 2 to illustrate this contrast to the LP discharge displayed in FIG. 1.

FIG. 2 shows a diagrammatic representation of key features of a High Pressure mercury discharge lamp.

As in the LP discharge, an increase in Hg vapour pressure increases impedance, hence increasing voltage (V) and consequentially power density of the lamp. The pressure gradient is continuous between a LP and HP discharge however a clear distinction is made to that of a HP discharge when the temperature of the (Hg) ions and electrons reach an (approximate) equilibrium referred to as a Local Thermal Equilibrium (LTE) as shown in FIG. 3. The temperature equality between atom/ion and electron is due to increased elastic collisions occurring because of increasing pressure. This produces numerous fundamental changes to the way the lamp functions, two key distinctions being the radiant efficiency and spectral output.

FIG. 3 shows the relationship between the temperature of Hg atoms/ions and electrons in relation to pressure.

Losses in elastic collision are proportional to the difference between a low energy electron to that of a high energy atom/ion (ie. LP discharge atom/ion temperature in the range of 300K to 700K and electron temperature above 10,000K. HP discharge has both atom/ion temperature generally between 4,000K and 11,000K depending on lamp conditions, meaning that when LTE is reached, elastic losses approach zero. Additionally, as power density increases so does the temperature of the lamp and in particular the arc which develops in the high pressure lamp, enabling thermal excitation and its subsequent emission. Although the lamp temperature increases, the thermal losses are not surprisingly low due to the low thermal conductivity of Hg. The implications being the LTE provides disproportionate radiant efficiency benefits to the HP discharge in comparison to that of the LP discharge. The arc develops because of a radial temperature gradient within the lamp; as temperature increases so does ionization (producing electrons referred to as current carriers) meaning that the current density is highest at the axis of the electrodes. This means that the LTE as a consequence has a significant increase in net radiant efficiency (FIG. 4). The stages displayed in FIG. 4 show the transition between the optimal LP discharge (labelled 2) to reduction in efficiency with increasing pressure/power to that more commonly used in UV reactors (between points 2 and 3) and the increasing efficiency of the HP discharge at the most common pressure region i.e. medium pressure UV lamps (labelled 4).

FIG. 4 shows the luminous efficiency of a mercury plasma discharge in relation to pressure.

The second implication of increasing pressure and plasma temperature is that of changing spectral output. The LP discharge is dominated by atomic collision and spectral emission from excitation, hence the two narrow and dominant emission lines at 253.7 nm and 185 nm, this changes with increasing pressure, which is thought due to:

1. Additional excitations occur from excited states to greater energy levels, producing numerous further emitted photons at different wavelengths
2. Ionization occurs when subsequent excitations exceed atomic energy levels and a photon is then emitted on atom/ion recombination (contributing to spectral continuum's e.g. 200-230 nm Hg continuum
3. Bremsstrahlung—the process by which photons are emitted during acceleration or deceleration within the plasma (also producing a continuous spectrum)

Therefore the HP discharge can be characterised by a high density high efficiency discharge with a spectral output form the UV to the Infra-Red (IR). Although the spectral output far exceeds that of LP discharge, the plasma efficiency enables the total radiant efficiency to be approximately ⅓ of that of a LP discharge. With similar advances in high frequency electronic drivers as for the LP discharge, the expected lamp life can be between 2,000 to 8,000 hours dependent on lamp design parameters. The practical implications means that compared to a LP discharge a far higher UVC density can be achieved in more efficient discharge in respect to radiant efficiency, however a compromise is made with a lower spectral efficiency.

Metal Halide (MH) Lamps

The efficiency of the HP plasma cannot be optimised or improved by pressure control as discussed for the LP discharge because it already functions in the LTE. However in visible lighting a resourceful method has been employed to enable the use of elements with desirable excitation and ionization energies but with too high a boiling point or too low a vapour pressure. The use of a halogen in conjunction with a desirable element will in most cases result in the reduction of the boiling point, enabling it to be used as directly or as part of a HP plasma. Iodine is often the selected halogen over bromine and chlorine as it is less reactive with internal lamp components whilst also generally producing the highest vapour temperature compared to other halogen compounds. The halide (in addition to the halogen component) is usually metal and hence the term Metal Halide (MH) is/are added to a high pressure Hg discharge. The Hg then performs the role of a 'buffer gas' which provides majority of the required gas vapour and electrical properties, although in this case does also contribute to the spectral output. The spectral output is almost entirely determined by the additional metal content$_{73}$ due to the fact the excitation potential of the metals used are comparatively much lower than Hg (FIG. 5). Although in most respects such a plasma can be considered similar to a pure Hg HP discharge the added halides can have a disproportional effect on lamp running conditions such as the size of the arc, both arc broadening and narrowing impacted by the electron carrying capacity.

FIG. 5 shows a diagrammatic representation of key features of a metal halide and mercury lamp.

The lower vapour temperatures provided by the metals used in their halide form enables them to be in the vapour phase whilst at the operational temperatures of the lamp. As the temperatures increase towards the arc the halide dissociates and associates at lower temperatures at the lamp wall (FIG. 6). When the halide is disassociated at the lamp arc, excitation of both the metal and halogen is possible, however due to the higher energy potentials of the halogen practically no excitation energy is emitted, meaning the output is dominated by the spectral characteristics of the metal rather than the Hg or halogen.

FIG. 6 shows a diagrammatic representation of halide cycle from lamp wall to lamp arc.

The MH lamp appears in many ways to be the ideal solution to the limitations of low power densities or low spectral efficiencies associated with the LP and HP discharges respectively. In fact, the potential for MH lamps to produce spectral efficiencies (visible region) of 34% and enhance colour rending facilitated its entry into the lighting market. The ability of MH lamps to be used for UV generation is limited. Experiments on iodide additives (iron (FeI2), cobalt (CoI2), manganese (MnI2), antimony (SbI2)) to assess their impacts on UV outputs, and although FeI2 and MnI2 enhanced the UVA output, none of the iodides improved the output in the UVC region. Presumably this limitation is associated with the need for a lower excitation potential required for effective MH operation.

Although the MH lamp provides highly desirable spectral and electrical characteristics, numerous practical problems were encountered and had to be overcome before commercial MH lamps were widely produced. One such limiting factor for the high intensity discharge (HID) is lamp life, which is closely associated with the high temperatures and small lamp geometry. One benefit of a lamp running at a temperature above 500° C. is that the absorption band at 215 nm which develops with time in quartz is removed. The absorption (thought to be due to loss of oxygen from the silica lattice) is removed by heating above 500° C. and thus a lamp with a quartz envelope running at or above this temperature is assumed to reverse such a formation. As a MH lamp is designed with much smaller geometries and higher pressures, a geometry and pressure similar to that of a MP lamp is likely to gain the benefits of a HP discharge without the geometry related issues of a visible HID lamp.

UV Source Selection

Low pressure (LP) and high pressure (HP) mercury (Hg) lamps dominate the UV disinfection market due to their relative operating simplicity and reasonable energy efficiency. Numerous improvements have been made in LP lamps, however their greatest limitation is internal losses caused by its low internal pressure. Improvements have also been made to HP lamps however ultimately their limitation in further efficiency improvements are related to the spectral output, determined by the lamp pressure.

To meet the needs of a high efficiency and high density lamp, the metal halide (MH) lamp has been proposed due to its success in visible lighting, and if the concept could be successfully applied to UV generation it would provide a desirable solution. The present work identifies one limitation of prior attempts as relating to the reliance upon Hg as the primary lamp filling which restricts the use of MH components with spectral lines of higher energy and therefore optimisation of spectral output in the UVC region.

Preferred performance objectives to enable widening of the upper energy density range of disinfection applications of the lamp include:

1. An optimised spectral output between 200-230 nm and 260-280 nm
2. Ability to run on a conventional lamp driver i.e. electromagnetic or electronic mercury/metal halide ballast
3. Closely matched geometrical dimensions of a medium pressure Hg lamp
4. A germicidal radiant efficiency better than that of an equivalent Hg based lamp To warrant switching from a traditional Hg based HP lamp it would be preferable to offer a competitive advantage i.e. increased germicidal efficiency. An approximate figure of 12% germicidal efficiency is typical for a Hg HP lamp; however, efficiency will be related to lamp diameter i.e. the losses incurred from photon production at the lamp arc to that of emission of the lamp wall. Thus 12% can be used as a guideline figure but a direct efficiency comparison of any proposed lamp to a Hg lamp of equal diameter would need to be conducted.

Desirable performance objectives include:

1. A germicidal radiant efficiency of 20% or greater
2. The ability to select an increased area of spectral output i.e. at 200-300 nm or 260-280 nm
3. No Hg lamp fillings
4. A germicidal power density equal to or greater than a conventional medium pressure Hg lamp These design characteristics are specifically of a narrow scope to enable a design concept and investigation to be undertaken. Additional performance data will relate to specific applications (including but not necessarily exclusive to water disinfection), comprising for example a detailed assessment including the effect on whole life costs (inclusive of lamp costs, lamp driver and combined efficiency) and specific application considerations such as the production of disinfection by-products (DBP).

To achieve the specified performance aim and objectives of the lamp the proposed concept is to produce a MH lamp with a dominant UVC output. This has been selected as a design concept as it is an adaptation of an existing approach used in visible lighting and is principally a high density discharge as required to meet the design objectives.

Potential reasons for selecting the concept of a UVC MH lamp may include the following:

Production of a HP discharge reduces the energy lost thermally in proportion to energy emitted as radiation, i.e. a benefit of a high pressure discharge The selection of an element (as part of a primary halide) that is spectrally preferential in both spectral and transitional lines than Hg and/or excitation energies are suitably low enough to enable a secondary halide with ideal excitation energies/spectral lines, i.e. the spectral benefits of the low pressure discharge Producing a suitable plasma from the MH or combination of MH to enable a stable arc and suitable plasma resistance to enable desired power densities i.e. mimicking power densities and electrical characteristics achieved currently by medium pressure Hg lamps Attempts to enhance the UVC spectral output of a Hg based MH lamp have not been successful to-date. One possible cause of this lack of success could be because of the previous selection of elements e.g. antimony which has preferential spectral lines that have a higher excitation energy than Hg and thus not favoured, as was seen for elements with lower excitation energies, e.g. iron. Therefore an alternative primary lamp filling is proposed which has similar physical characteristics to Hg whilst also having lower spectral lines (i.e. higher photon energies) than the lowest desired spectral region i.e. 200-230 nm. A suitable secondary lamp filling preferably has desirable excitation energies (spectral lines) and ionization energies, whilst providing functional vapour pressures both at lamp starting and running temperatures.

The minimum vapour pressure to produce useful radiation at 1000K (726.85° C.) is 133 Pa (1 torr) with possible elements to meet this condition being strontium, tellurium, magnesium, zinc, cadmium and caesium. Using an element in halide form in general increases vapour pressure, reduces the boiling temperature and metal iodides do not appreciably react with the fused silica such as magnesium and zinc.

The halide(s) and ideally iodide(s) preferably meet a number of criteria. The primary halide should ideally mimic the vapour pressure characteristics of Hg whilst having dominant spectral lines lower than 253.7 nm (i.e. a higher energy) enabling a secondary halide with a suitably high enough vapour temperature not to impact lamp characteristics, whilst having spectral lines of a desirable wavelengths 200-230 nm and/or 260-280 nm to be preferentially selected in excitation. The halide also preferably needs to be stable at lamp wall temperatures and dissociate at arc temperatures (4000-6000K). Consequentially a spectral and functional assessment of primary and secondary lamp fillings is required to enable a lamp concept to be developed.

According to a first aspect of the invention there is provided a mercury-free high-pressure metal-halide ultraviolet gas-discharge lamp comprising a primary filling of at least one of osmium, germanium and tellurium, and a secondary filling comprising at least one of tin, antimony, indium, tantalum and gold.

Preferably, the primary lamp filling is tellurium and the secondary lamp filling is antimony.

Preferably, the halogen of the metal-halide comprises iodine.

Preferably, the primary lamp filling is TeI2 and the secondary lamp filling is SbI3.

Preferably, the ratio of iodine to tellurium is non-stoichiometric, preferably with a reduced iodine content.

Preferably, the ratio of iodine to tellurium is no greater than 2:1, preferably no greater than 1.5, more preferably less than 1.0. The ratio may be by mass in gaseous form.

Preferably, the lamp output comprises electromagnetic radiation of wavelength in the range 200-300 nm.

Preferably, the primary lamp filling has similar physical characteristics, such as vapour pressure, to mercury whilst also having lower spectral lines (i.e. higher photon energies) than the lowest desired spectral region i.e. 200-230 nm, more preferably having dominant spectral lines lower than 253.7 nm.

Preferably, the secondary lamp filling has suitably high enough vapour temperature not to impact lamp characteristics, both at lamp starting and running temperatures, whilst having spectral lines of a desirable wavelengths 200-230 nm and/or 260-280 nm to be preferentially selected in excitation.

In some embodiments, alternative enclosure materials other than quartz may be used, such as (but not limited to) ceramic materials. This may reduce if not eliminate the effects of the lamp filling otherwise reacting with the lamp body material.

In some embodiments, the lamp may be driven without the use of electrodes, for example inductively or with the use of microwaves. This may limit the effects of material reactions which may arise, for example, when using tungsten based electrodes and/or iodine in the fillings.

Further features of the invention are characterised by the dependent claims.

Any apparatus feature as described herein may also be provided as a method feature, and vice versa.

SUMMARY OF THE INVENTION

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

BRIEF DESCRIPTION OF THE SEVERAL VIEWS OF THE DRAWINGS

These and other aspects of the present invention will become apparent from the following exemplary embodiments that are described with reference to the following figures in which.

OVERVIEW OF LAMP STRUCTURE

Description of Specific Embodiments of the Invention

Figure 1:
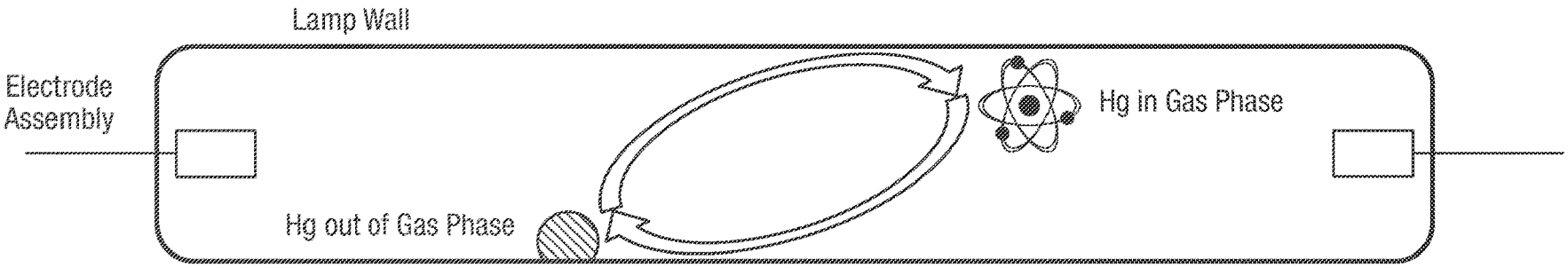
FIG. 1 shows a diagrammatic representation of key features of a Low Pressure mercury discharge lamp.
Figure 2:
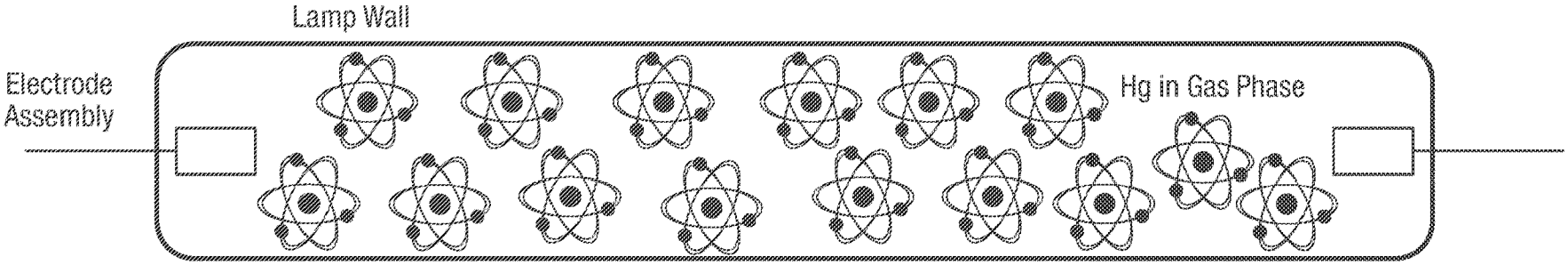
FIG. 2 shows a diagrammatic representation of key features of a High Pressure mercury discharge lamp.
Figure 3:
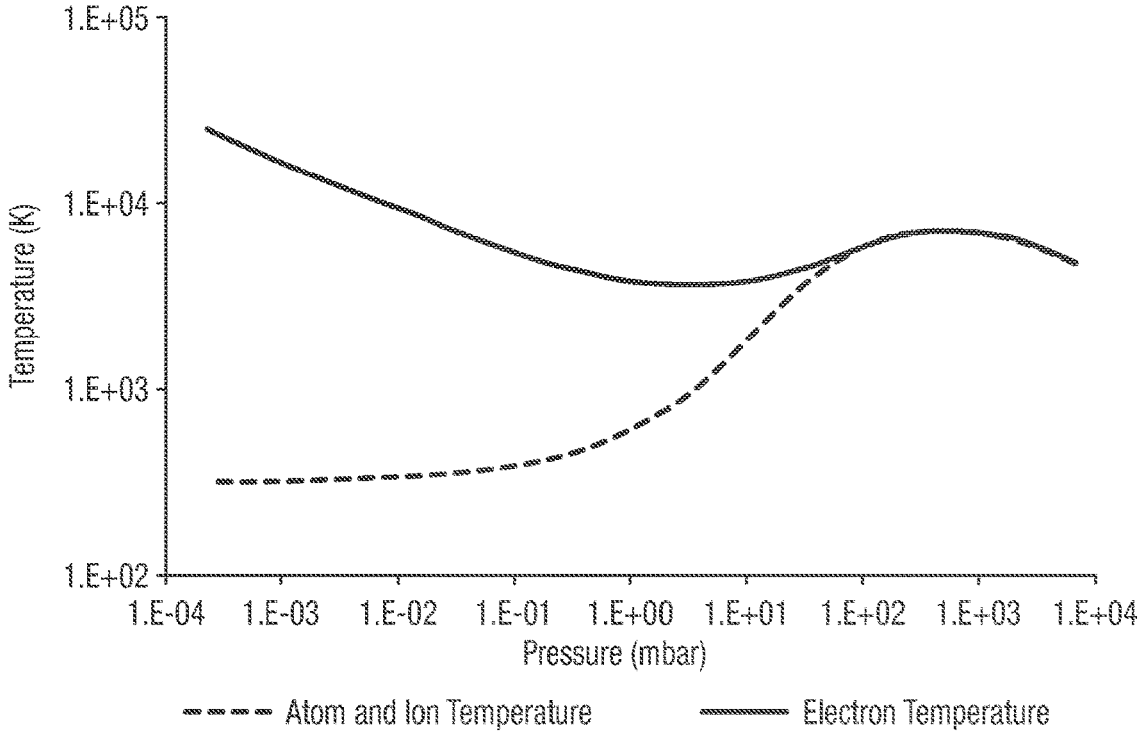
FIG. 3 shows the relationship between the temperature of Hg atoms/ions and electrons in relation to pressure.
Figure 4:
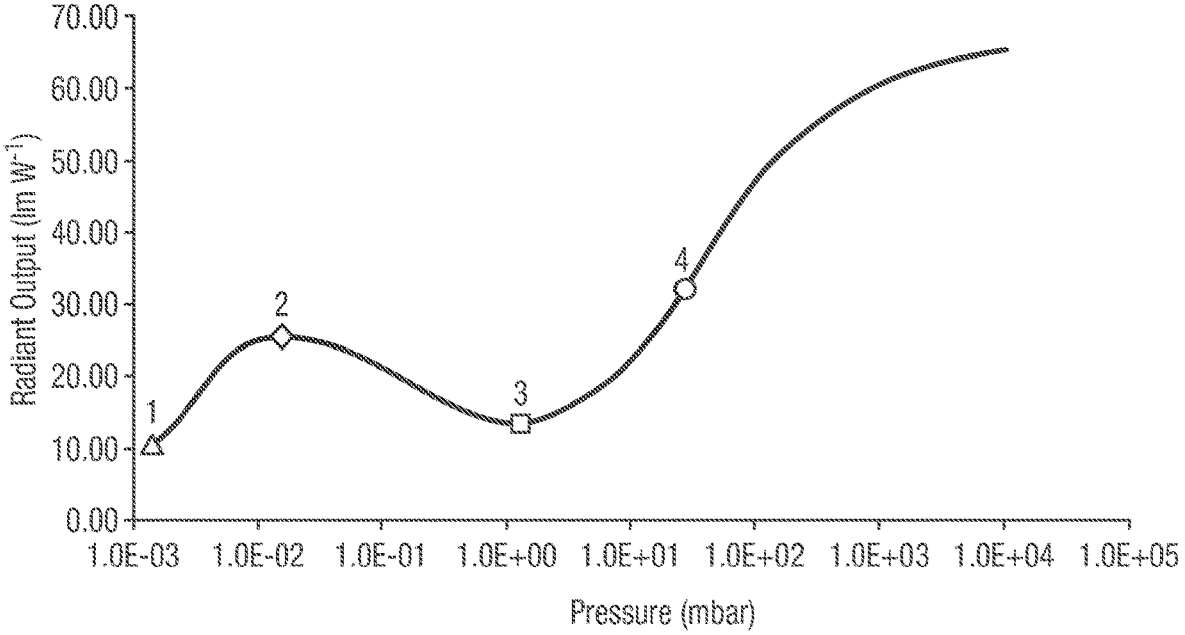
FIG. 4 shows the luminous efficiency of a mercury plasma discharge in relation to pressure.
Figure 5:
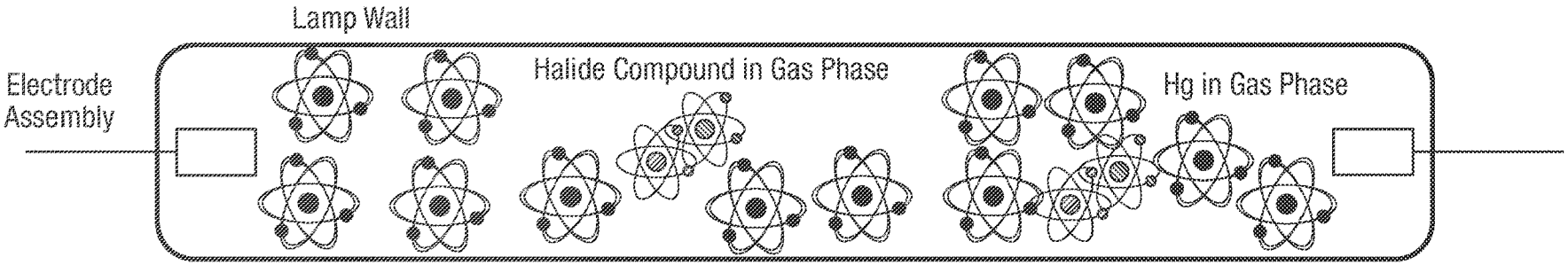
FIG. 5 shows a diagrammatic representation of key features of a metal halide and mercury lamp.
Figure 6:
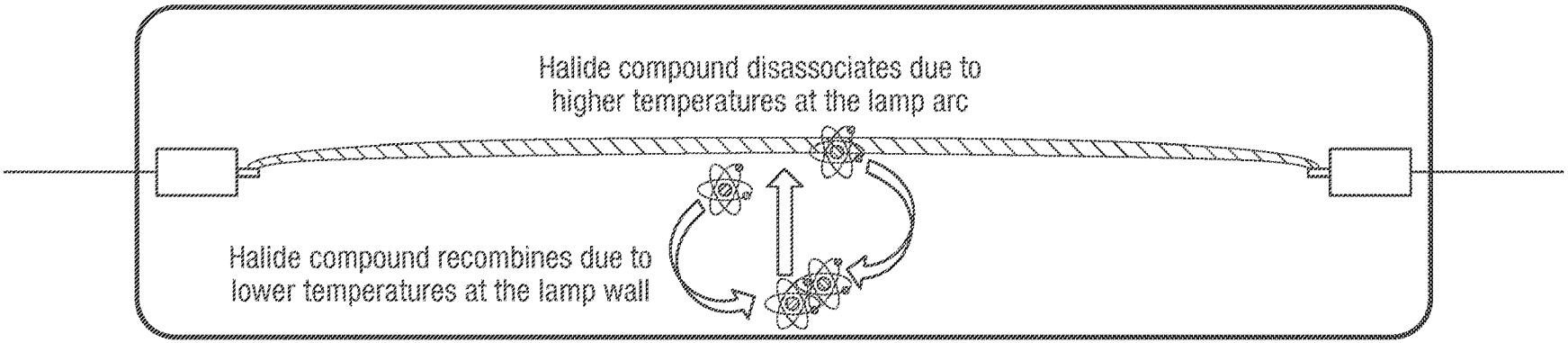
FIG. 6 shows a diagrammatic representation of halide cycle from lamp wall to lamp arc.
Figure 7:
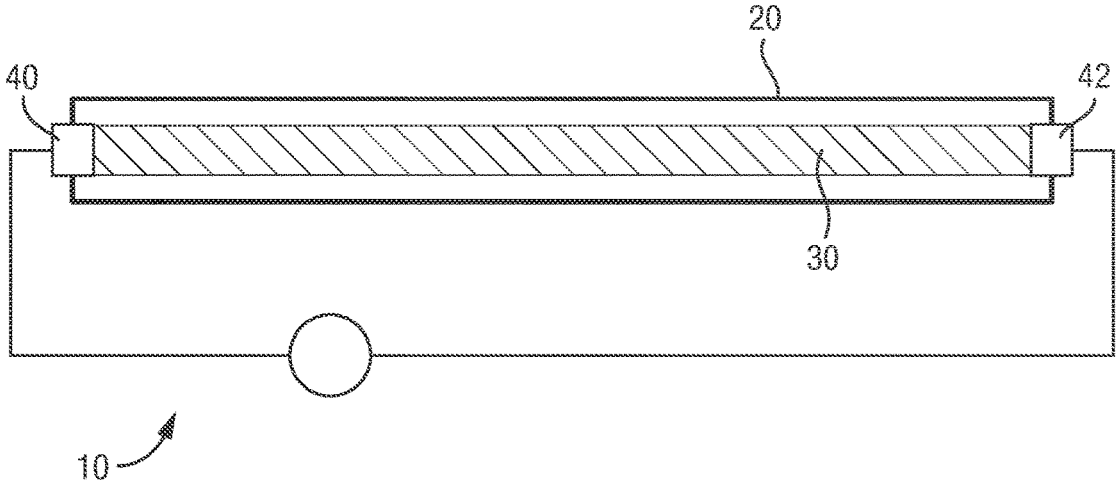
FIG. 7 shows a gas-discharge lamp.

FIG. 7 shows a gas-discharge lamp 10, comprising an elongate sealed tube 20, preferably of fused quartz or fused silica, filled with a starting or auxiliary gas and, in operation, a gaseous quantity of radiating working material 30. Two spaced electrodes 40,42 are disposed in the lamp, which are used to ignite the starting gas. These electrodes are typically made from tungsten doped with thorium, and are preferably sealed into opposite ends of the lamp. In a preferred embodiment, a lamp may be 1 m-2 m in length, and have an outer diameter that is less than 29 mm such that it can replace a pre-existing mercury lamp without further modification required.

Spectral Selection of Potential Elemental Candidates

An initial assessment of potential elemental candidates was undertaken by identifying dominant spectral lines (from a neutral atom) from elements of rows 4-6 of the transition metals, rows 4-6 of the metalloids and rows 3-4 of the post transition metals from the periodic table. A summary of this information is displayed below in Tables 1-3.

Spectral lines provided in tables are in order of relative values high to low. Where values are equal wavelengths they are stated in order of wavelength i.e. lowest wavelength first, except where there are more than 3 of equal value or more than 1 value in third wavelength where the values are stated

TABLE 1

Dominant three spectral lines for the transition metals using relative figures of a neutral atom

| Element | λ1 (nm) | λ2 (nm) | λ3 (nm) |
|---|---|---|---|
| Scandium | 391.2 | 390.5 | 402.0/402.4 |
| Titanium | 399.9 | 365.3 | 430.6/364.3 |
| Vanadium | 437.9 | 411.2 | 438.5 |
| Chromium | 357.9 | 425.4 | 359.3/427.5 |
| Manganese | 403.1 | 200.4 | 403.1 |
| Iron | 248.3 | 373.5 | 248.8/358.1/372.0/373.7/374.6 |
| Cobalt | 345.4 | 340.5 | 350.2 |
| Nickel | 341.5 | 352.5 | 351.5/361.9 |
| Copper | 324.8 | 327.4 | 223.0/224.4/521.8 |
| Zinc | 213.9 | 334.5 | 481.1 |
| Yttrium | 410.2 | 1790.3 | 1805.0 |
| Zirconium | 360.1 | 386.4 | 389.0 |
| Niobium | 405.9 | 408.0 | 410.1 |
| Molybdenum | 379.8 | 386.4 | 390.3 |
| Technetium | 363.6 | 403.2 | 429.7 |
| Ruthenium | 372.8 | 349.9 | 372.7 |
| Rhodium | 369.2 | 343.5/352.8/365.8 | |
| Palladium | 340.5 | 361.0 | 363.5 |
| Silver | 328.1 | 338.3 | 520.9/546.5 |
| Cadmium | 643.8 | 228.8 | 346.6/361.1/508.6 |
| Hafnium | 286.6 | 307.3 | 368.2 |
| Tantalum | 265.3 | 271.5 | 264.7 |
| Tungsten | 400.9 | 407.4 | 429.5 |
| Rhenium | 346.0 | 346.5 | 200.4/204.9 |
| Osmium | 201.8 | 204.5 | 203.4 |
| Iridium | 208.9 | 203.4 | 215.8/254.4 |
| Platinum | 306.5 | 340.8 | 304.3 |
| Gold | 201.2 | 267.6 | 202.1/242.8 |

TABLE 2

Dominant three spectral lines for the post transition metals using relative figures of a neutral atom

| Element | λ1 (nm) | λ2 (nm) | λ3 (nm) |
|---|---|---|---|
| Gallium | 417.2 | 294.3 | 403.3 |
| Indium | 451.1 | 410.2 | 325.6 |
| Tin | 284.0 | 235.5 | 286.3 |
| Thallium | 351.9 | 535.0 | 377.6 |
| Lead | 405.8 | 364.0 | 280.2/283.3 |
| Bismuth | 306.8 | 223.1 | 289.8 |

TABLE 3

Dominant three spectral lines for the metalloids using relative figures of a neutral atom

| Element | λ1 (nm) | λ2 (nm) | λ3 (nm) |
|---|---|---|---|
| Germanium | 206.9 | 204.2 | 209.4 |
| Arsenic | 286.0 | 278.0 | 189.0 |
| Antinomy | 231.2 | 252.9 | 259.8 |
| Tellurium | 200.2 | 214.3 | 182.2/185.7/199.5 |
| Polonium | 300.3 | 245.0 | 255.8 |

From the spectral information summary, eight possible elements appear to have desirable spectral characteristics, three for a primary filling (osmium, germanium and tellurium) and five for a secondary filling (tin, antimony, indium, tantalum and gold). To further assess these potential elements critical data of their known physical properties as elements and halides are presented in Table 4.

TABLE 4

| Critical physical properties of identified elemental candidates for MH lamp fillings | |
|---|---|
| Element | Physical Properties (m.p. = melting point b.p. = boiling point) |
| Osmium | Element m.p. = 3045° C. b.p. = 5020° C. |
| | $OsBr_4$ m.p. 350° C. b.p. no data and no data for OsI |
| Germanium | Element m.p. = 937.4° C. b.p. = 2830° C. |
| | $GeI_2$ m.p. = 448° C. b.p. = no data |
| | $GeBr_2$ = m.p. 144° C. b.p. = no data |
| Tellurium | Element m.p. = 449.5° C. b.p. = 1390° C. |
| | $TeBr_4$ m.p. = 388° C. b.p. = 414° C. |
| | $TeI_4$ m.p. = 280° C. b.p. = 283° C. |
| Tin | Element m.p. = 231.91° C. b.p. = 2687° C. |
| | $SnBr_4$ = m.p. 33° C. b.p. = 203.3° C. |
| | $SnI_4$ = m.p. 144.5° C. b.p = 346.° C. |
| Antimony | Element m.p. = 630.5° C. b.p. = 1635° C. |
| | $SbBr_3$= m.p. 96.6° C. b.p. = 288° C. |
| | $SbI_3$ = m.p. 171° C. b.p = 400° C. |
| Indium | Element m.p. = 303.5° C. b.p. = 1453° C. |
| | $InBr_3$ = m.p. = 436° C. sublimation = 371° C. |
| | $SbI_3$ = m.p. 436° C. |
| Tantalum | Element m.p. = 2996° C. b.p. = 5425° C. |
| | $TaBr_5$ = m.p. 256° C. b.p. = 344° C. |
| | $TaI_5$ = m.p. 496° C. b.p. = 543° C. |
| Gold | Element m.p. = 1064° C. b.p. = 2660° C. |
| | $TaBr_5$ = metastable |
| | AuI decays at 100° C. |

The three candidates for primary lamp fillings identified based on spectral criteria can be reduced to a single candidate, tellurium due to the insufficient data supporting the stability of osmium and germanium as an iodide in the gas phase.

Of the five candidates for secondary lamp fillings gold and indium were rejected as candidates as they would not produce suitable iodide, leaving tantalum, tin and antimony as possible candidates. Tantalum has a higher boiling point (BP) and although tin provides the lowest BP the spectral characteristics of antimony (two lines being approx. 260 nm) and its previously use in lamps makes it the preferred choice for the initial concept prototype. In addition, there are practical limitations are incurred with the use of tin.

Comprehensive Spectral Assessment of Potential Candidates

A more detailed spectral assessment of tellurium and antimony was undertaken with the addition of Iodine due to common use as halogen for MH lamps. The dominant spectral lines from both neutral and singly ionized elements are displayed in tabular form and the complete spectral data has been displayed graphically. A summary of spectral data in the UVC regions of the three elements is also displayed. Data obtained for Sb contains spectral lines from neutral to −4 ionization whereas data for Te was only available for neutral and −1 ionization states.

Tellurium

TABLE 5

| Dominant spectral lines from neutral and singly ionized tellurium | | | |
|---|---|---|---|
| Dominant Spectral Lines of neutral atom tellurium (Te I) | | Dominant Spectral Lines of singly ionized tellurium (Te II) | |
| Intensity (Rel) | Wavelength (nm) | Intensity (Rel) | Wavelength (nm) |
| 500 | 182.2 | 40 | 107.8 |
| 500 | 185.7 | 50 | 117.4 |
| 500 | 199.5 | 60 | 117.6 |

TABLE 5-continued

| Dominant spectral lines from neutral and singly ionized tellurium | | | |
|---|---|---|---|
| Dominant Spectral Lines of neutral atom tellurium (Te I) | | Dominant Spectral Lines of singly ionized tellurium (Te II) | |
| Intensity (Rel) | Wavelength (nm) | Intensity (Rel) | Wavelength (nm) |
| 1000 | 200.2 | 50 | 132.5 |
| 250 | 208.1 | 250 | 352.1 |
| 700 | 214.3 | 250 | 400.7 |
| 120 | 214.7 | 900 | 465.4 |
| 20 | 225.9 | 800 | 564.9 |
| 50 | 238.3 | 1000 | 570.8 |
| 60 | 238.6 | | |
| 200 | 972.3 | | |
| 250 | 1005.2 | | |
| 400 | 1109.0 | | |
| 250 | 1148.7 | | |

Figure 8:
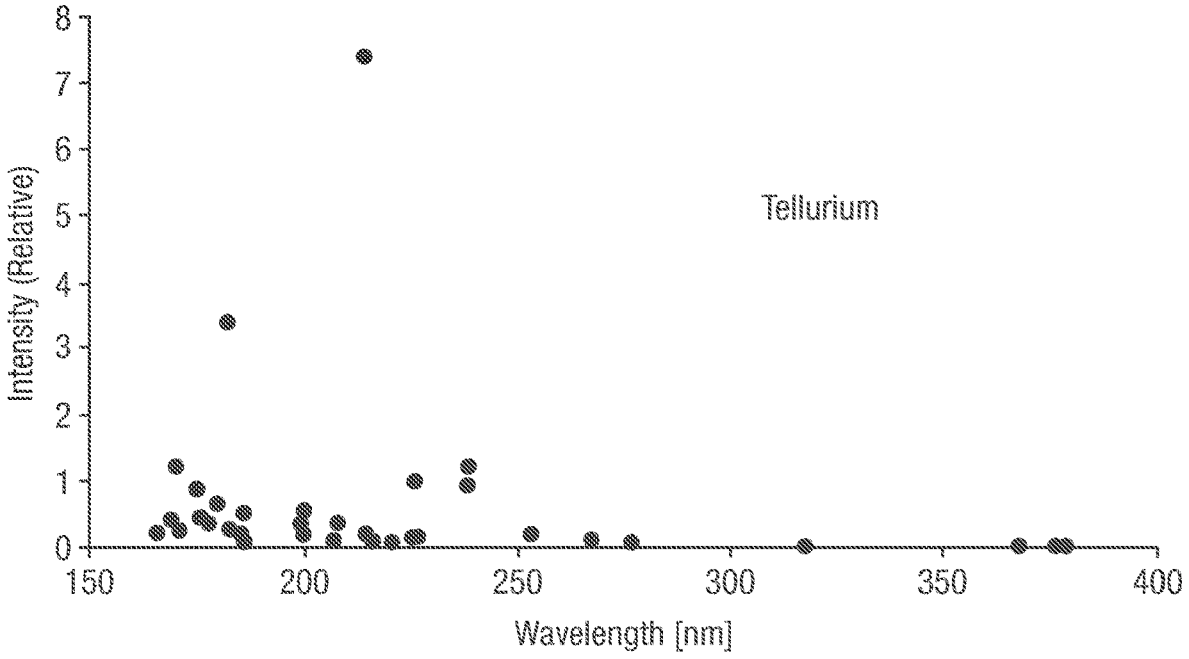
FIG. 8 shows spectral data points for tellurium from all ionization levels.

FIG. 8 shows spectral data points for tellurium from all ionization levels

Antimony

TABLE 6

| Dominant spectral lines from neutral and singly ionized antimony | | | |
|---|---|---|---|
| Dominant Spectral Lines of neutral antimony atom (Sb I) | | Dominant Spectral Lines of singly ionized antimony (Sb II) | |
| Intensity (Rel) | Wavelength (nm) | Intensity (Rel) | Wavelength (nm) |
| 400 | 187.1 | 800 | 127.5 |
| 60 | 205.0 | 800 | 132.7 |
| 400 | 206.8 | 800 | 138.5 |
| 40 | 214.0 | 1000 | 138.8 |
| 40 | 214.5 | 800 | 143.6 |
| 600 | 217.6 | 800 | 157.6 |
| 100 | 217.9 | 1000 | 161.0 |
| 120 | 220.8 | 400 | 556.8 |
| 1000 | 231.4 | 500 | 600.6 |
| 800 | 252.9 | 300 | 613.0 |
| 600 | 259.8 | | |
| 400 | 287.8 | | |
| 250 | 323.3 | | |
| 300 | 326.7 | | |

Figure 9:
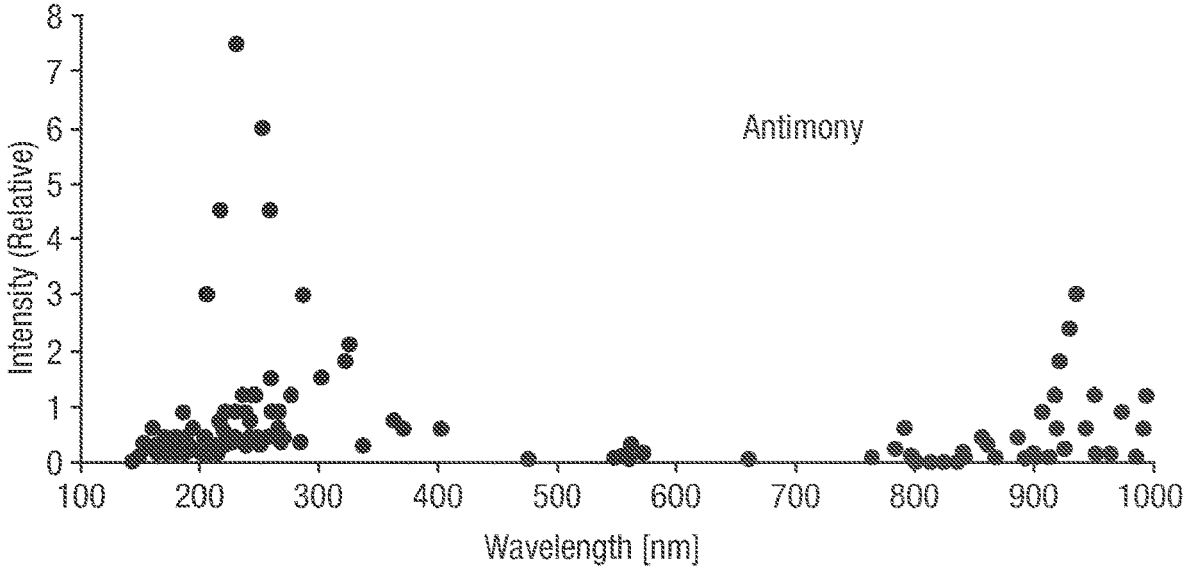
FIG. 9 shows spectral data points for antimony from all ionization levels.

FIG. 9 shows spectral data points for antimony from all ionization levels

Iodine

TABLE 7

| Dominant spectral lines from neutral and singly ionized iodine | | | |
|---|---|---|---|
| Dominant Spectral Lines of neutral Iodine atom (I I) | | Dominant Spectral Lines of singly ionized Iodine (I II) | |
| Intensity (Rel) | Wavelength (nm) | Intensity (Rel) | Wavelength (nm) |
| 130 | 145.8 | 500 | 103.5 |
| 200 | 151.8 | 500 | 114.0 |
| 200 | 170.2 | 500 | 116.1 |
| 150 | 178.3 | 1000 | 116.6 |
| 1000 | 183.0 | 500 | 117.9 |
| 200 | 184.4 | 800 | 118.7 |
| 25 | 206.2 | 500 | 119.1 |
| 130 | 511.9 | 1000 | 122.1 |
| 130 | 804.4 | 1000 | 123.4 |
| 200 | 905.8 | 1000 | 133.7 |

TABLE 7-continued

| Dominant spectral lines from neutral and singly ionized iodine | | | |
|---|---|---|---|
| Dominant Spectral Lines of neutral Iodine atom (I I) | | Dominant Spectral Lines of singly ionized Iodine (I II) | |
| Intensity (Rel) | Wavelength (nm) | Intensity (Rel) | Wavelength (nm) |
| | | 150 | 516.1 |
| | | 500 | 533.8 |
| | | 250 | 534.5 |
| | | 100 | 546.5 |
| | | 500 | 562.6 |

Figure 10:
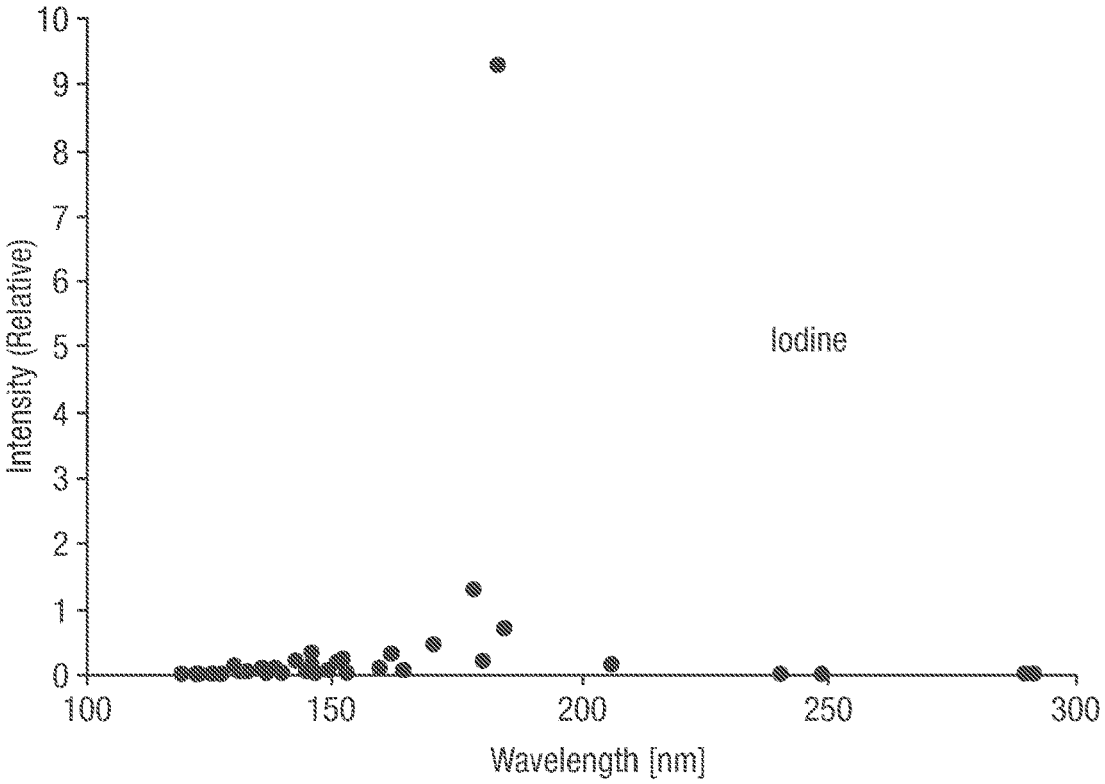
FIG. 10 shows spectral data points for iodine from all ionization levels.

FIG. 10 shows spectral data points for iodine from all ionization levels.

Combined Data

TABLE 8

| Weighting of spectral emission lines for iodine, antimony and tellurium Top 5 elemental spectral lines | | | |
|---|---|---|---|
| | Iodine (I) | Antinomy (Sb) | Tellurium (Te) |
| 1 | 183.0 nm | 231.4 nm | 214.3 nm |
| 2 | 178.3 nm | 252.9 nm | 182.2 nm |
| 3 | 184.4 nm | 259.8 nm | 170.0 nm |
| 4 | 170.2 nm | 217.6 nm | 238.6 nm |
| 5 | 133.0 nm | 936.3 nm/287.8 nm/ 206.8 nm | 225.9 nm |
| % relative intensity from top 5 lines in relation to total radiation | 76.8 | 28.4* | 63.9 |
| % relative intensity below 250 nm | 97.9 | 46.5 | 97.7 |

*indicates value calculated using 206.8 nm as 5th most intense spectral line.

The spectral data for tellurium exhibits predominant lines either below or in the lower region of the 200-230 nm target spectral range whilst maintaining 97.7% of the spectral range below 250 nm.

Seven of the eight most dominant spectral lines of antimony are ideally placed within the two target spectral areas. Although a secondary region of spectral emission occurs from antimony between 800 nm-1000 nm the overall lines produced appear favourable in respect of the desired spectral range meeting both the target areas of 200-230 nm and 260-280 nm.

The underlying question is that of the transition lines for both tellurium and antimony. The concept of a High Pressure discharge means that numerous transition lines will likely be produced under the lamp pressures from increased collision frequency as in the HP Hg discharge. Also with increased pressures will be spectral emission from other sources such as recombination and bremsstrahlung. Therefore the total spectral output and spectral radiant efficiency will only be determined when measured at the designed lamp pressures.

Functional Assessment

A spectral assessment of elements has been undertaken with tellurium and antimony highlighted as potentially suitable elements for use in a UV MH lamp. In addition to a desirable spectral output the fillings must also display functional characteristics.

Suitability of Halide Compounds for Lamp Plasma

There are a number of key physical characteristics which any potential halide must meet particularly in relation to its ionization energies, thermal and vapour characteristics and specific molecular interactions associated with the halide compound.

Ionization Energy

A necessary feature of a lamp filling is a relatively low ionization level, which aids the starting of a lamp. A lower ionization level means less energy is required to produce free elections which in turn produce more electrons and so on, in what is described as the avalanche effect. As displayed in Table 9 both antimony and tellurium have lower ionization levels compared to mercury and hence should be suitable to initiate a plasma discharge.

TABLE 9

| Ionization energies for mercury, iodine, antimony and tellurium | | |
|---|---|---|
| Element | 1st Ionization | 2nd Ionization |
| Mercury | 10.4375 eV | 18.7568 eV |
| Iodine | 10.45126 eV | 19.1313 |
| Antinomy | 8.60839 eV | 16.63 eV |
| Tellurium | 9.0096 eV | 18.6 eV |

Arc Stability

A characteristic of the high pressure discharge is the arc contraction which if accounted for in design of a MP Hg lamp should produce a relatively stable straight arc; however, this is not guaranteed for a MH lamp. Previous work with Hg based MH lamps has identified significant impacts of MH additives on the lamp arc either constrictive or broadening even though the proportional amount of the MH additive is minimal to that of Hg within the lamp. Recorded examples in literature are thorium, scandium and other rare earth metals which constrict the arc and make it more susceptible to internal fluctuations, whereas addition of alkaline metals (i.e. caesium, sodium, potassium) have the opposite effect and broaden the lamp arc having a stabilising effect.

Arc stability is a critical factor in determining the functional suitability of the proposed plasma discharge concept, not simply because of undesirable anisotropic radiant characteristics due to the rising of the arc above the lamp axis when in the horizontal position (which can also cause condensation of MH on the underside of the arc), but in extreme cases the lamp wall can physically melt causing it to self-destruct. The reasoning for the instability of the HP arc can be identified when assessing its fundamental thermal characteristics. The HP pressure lamps used in UV disinfection are characterised by having a significantly longer arc length than lamp diameter of the lamp. The arc is central to the lamp which is in part due to the physical characteristics imposed upon the arc by the walls of the lamp and in this case is referred to as a 'wall stabilised' arc. This is a desirable feature of a well-designed MP lamp and is an aim for a high density, high efficiency MH lamp.

The wall stabilised arc is a feature of a positive radial profile temperature which displays a sharp decline in temperature towards the lamp wall from the arc. This means that movements in the arc are stabilised due to cooling/heating effects incurred from moving from the centre of the lamp. If the lamp has a temperature gradient that drops rapidly from the arc rather than at the lamp wall there is no stabilised effect. Such instability causes the arc to rise (when mounted horizontally) with resulting spectral problems but also causing the possibly of quartz softening or halide condensation under the arc. A critical design criterion to indicate a wall stabilised arc is the ratio of average excitation potential $\bar{v}$ to that of the ionization potential and vi being greater than 0.585 i.e. $\bar{v} \geq 0.585$ vi. Tellurium and antimony have a ratio of 0.72 and 0.78, respectively and thus indicate that a wall stabilised arc should be produced. As both Tellurium and Antimony both have lower ionization potentials to that of mercury (Table 9) it should produce a more stable arc and possible that of a stable higher power density lamp to mercury not accounting for any interactions of from the halide.

Thermal Characteristics of Elements

The lamp arc as previously discussed has a temperature of approximately 3700-4700° C. however the temperature of the lamp envelope is expected to be lower than 800° C. This by implication means that the high degree of thermal insulation is required not only to provide protection for the quartz envelope but also to restrict thermal losses of the discharge to maximise efficiency of the discharge. A number of data points for thermal conductivity are provided in Table 10 for Te and Sb for comparison to Hg and Zn that also produces a relatively high vapour pressure in elemental form. Data for Te and Sb are similar although the key difference is that mercury exhibits a steady increasing trend with temperature whereas Te exhibits a decreasing trend. As the data for Sb is only a single point little can be interpreted however compared to the data on Zinc (Zn) showing considerable more thermal conduction it appears that approximately similar thermal characteristics to that of Hg may be provided by a Te based lamp at temperatures at the lamp wall.

TABLE 10

Conductivity of elements at specified temperatures

| Element | Molecular Weight | Temperature ° C. | Conductivity (W $cm^{-1}$ °K) |
|---|---|---|---|
| Mercury (Hg) | 200.61 | 0 | 0.084 |
| | | 100 | 0.095 |
| | | 200 | 0.107 |
| | | 300 | 0.118 |
| | | 400 | 0.126 |
| | | 500 | 0.133 |
| Antimony (Sb) | 121.76 | 700 | 0.22 |
| Tellurium (Te) | 127.61 | 460 | 0.20 |
| | | 500 | 0.13 |
| Zinc (Zn) | 65.38 | 450 | 0.59 |
| | | 500 | 0.59 |
| | | 600 | 0.58 |
| | | 700 | 0.57 |

Metal Halide Characteristics and Interactions

Critical to the stability of any halide lamp proposed is stability and interaction between the halide compounds filling used for lamp filling, particularly the primary fill compound. As spectral selection identified only Te as an appropriate primary filling an assessment of literature on Te as a metal iodide has been undertaken with key information being provided alongside information for Sb in Table 11.

TABLE 11

Chemical properties of tellurium and antimony halides

| Compound | Oxidation State | Bromide | Iodide | Additional Information |
|---|---|---|---|---|
| Te | +½ | Te2Br | Te2I (Shiny Dark Cystals) | |
| Te | +1 | | (α)Te2I2 ⇐(ß)TeI Dark crystals α stable m.p. 185° C. ß metastable | |
| Te | +2 | TeBr2 Gas phase only; ΔHf(g) +15 kJ | TeI2 Gas phase only; ΔHf(g) +82 kJ | |
| Te | +4 | TeBr4 Yellow Crystal m.p. 388° C. b.p. 414° C. ΔHf(g) −188 kJ | TeI4 Black Crystal m.p. 280° C. b.p. 283° C. ΔHf(g) −69 kJ TeI4 sublimes to TeI4(g), TeI2 (g) + I2 (g). In can also form Te(s) + 2I2 (g) followed by equilibrium between solid and gas phase and then all in the gas phase | Mixed tetrahalide can be formed TeBr2I2 (m.p. 325° C., b.p. 420° C.) Te(I) + I2(I) TeI4(g), ΔHf = +62 kJ mol−1 TeBr4 and TeI4 decompose completely above 500° C. and 400° C. respectively forming TeX2 + X2 |
| Sb | | Sbr3 Colourless crystals m.p. 96.6° C. m.p. 288° C. ΔHf(g) 259.4 kJ | Sbl3 Ruby red crystals m.p. 171° C. b.p. 400° C. ΔHf(g) 100.4 kJ | Sbr2I can be formed (m.p. 88° C.) |

Table 11 describes both Te and Sb as iodides $TeI_4$ and $SbI_3$ respectively with m.p. and b.p. data as previously stated in Table 4 with little additional information to note regarding $SbI_3$. $TeI_4$ presents additional complexity when in the gas phase as required for a HP lamp discharge. Core reactions between Te and I from the solid to the gas phase, are described in Equations 1-5 below:

Equation 1 Thermal decomposition of tellurium tetraiodide in the vapour phase $$TeI_{4(g)} \rightleftharpoons TeI_{2(g)}+I_{2(g)}$$

(The proportion of $TeI_2$ formed is temperature dependent and increases with temperature, at ≥500° C. this is near completely Tele. There are also isolated $(TeI_4)_4$ tetramers.

Equation 2 Sublimation and deposition of tellurium dihalide $$Te_{(s)}+I_{2(g)} \rightleftharpoons TeI_{2(g)}$$

Equation 3 Sublimation and deposition of tellurium tetraiodide $$TeI_{2(g)} \rightleftharpoons Te_{(s)}+2I_{2(g)}$$

Equation 4 Thermal decomposition of iodine in the gas phase at temperatures above 600° C.

$$I_{2(g)}+I_{2(g)} \rightleftharpoons 2I_{2(g)}$$

Equation 5 Thermal decomposition of tellurium iodide in the gas phase at temperatures above 600° C.

$$2TeI_{2(g)} \rightleftharpoons Te_{2(g)}+2I_{2(g)}$$

To have Te in the gas phase it must transition from TeI4 through various states and compounds however above 600° C. Te will be in the gas phase although interchangeably as an iodide or diatomic Te. It is unknown whether this will impact the stability of the arc however to ensure Te does not condense into the solid phase a wall temperature of 600° C. must be maintained with a minimum I to Te ratio of 2:1. Complex iodide vapours can form and this is a possibility between Te and Sb iodides, possibly adding to further spectral and functional complexity, however as Sb will be a secondary filling it will comprise only of a small proportion to lamp performance, and for design purposes only the Te iodide formations will be assessed.

The proportion of iodine to that of the element in question is critical. Two methods are used to ensure an adequate amount of iodine is present. Firstly, provide exact iodine to element ratios are added to form a complete number of halogen compounds; secondly, an excess of iodine can be added to that of the element reducing the likelihood of elemental condensation at the lamp wall. In the latter case the there are problems associated with free I2 which is a strong light absorber and can cause loss of metals over time can cause problems with lamp functionality. In a Hg based lamp this is resolved with the formation of HgI2 which is transparent and relatively unstable.

Pressure Characteristics of Selected Halides

A critical component of lamp plasmas described above is the ability for the lamp filling to provide sufficient internal lamp pressure. In contrast there are known issues relating to having too high a pressure from halides and the need to limit the amounts used. As the MH lamp is designed to function around the same principal design criteria as a Hg HP lamp it is prudent to assess pressure of the lamp fillings in relation to temperature compared to that of Hg. Pressure data for both $TeI_4$ and $SbI_3$ are limited however pressure curves $Te_2I_2$ are displayed alongside those of $I_2$, $TeBr_4$, and Hg in FIG. 11.

Figure 11:
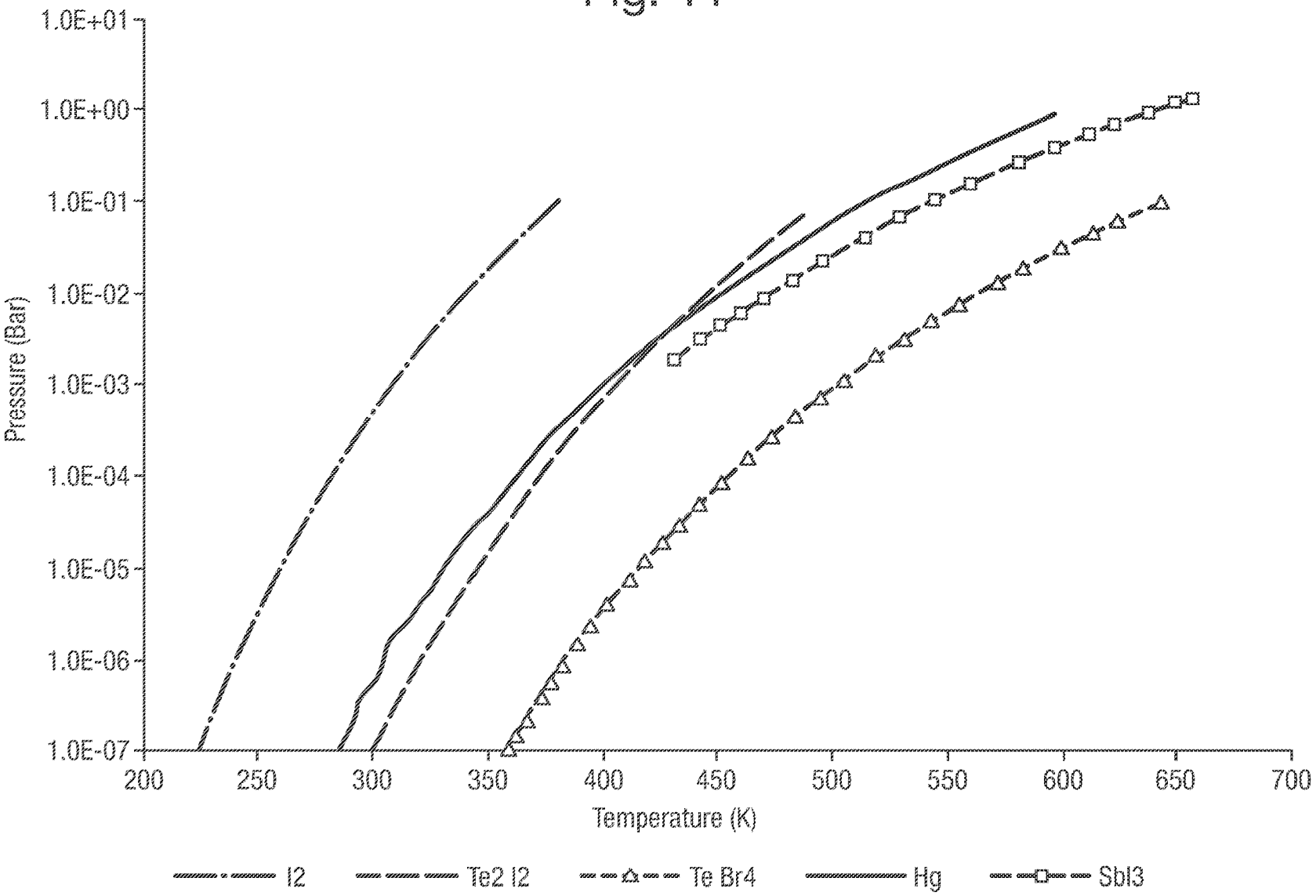
FIG. 11 shows vapour pressure curves for potential lamp fillings in respect to temperature for $I_2$, $Te_2I_2$, $TeBr_4$, Hg and $SbI_3$.

FIG. 11 shows vapour pressure curves for potential lamp fillings in respect to temperature for $I_2$, $Te_2I_2$, $TeBr_4$ Hg and $SbI_3$ The pressure curves displayed in FIG. 11 identify $I_2$ as exhibiting significantly higher pressure at equivalent temperatures to all of the halides assessed, whereas $TeBr_4$ produced significantly lower pressures to all other comparative pressure curves, as per the general trend for iodides in comparison to bromides discussed previously. Similar pressure characteristics can be seen with both $TeI_4$ and $SbI_3$ however the former shows the closest match to the Hg pressure curve and the latter a slightly offset curve with that of a lower pressure. $TeI_4$ displays a near ideal pressure curve for that of a MH lamp to replace that of a HP Hg lamp. Some caution is required as the data is based upon $TeI_2$ and $I_2$ and so based on the higher pressure curve for the latter this could be positively distorted when comparing it to the use of solely $I_2$. Having the $I_2$ at the higher pressures described may also incur efficiency losses due to convection with increasing internal pressures in Hg based HP lamps.

Summary of Functional Assessment

Spectrally Te provides suitable lines for use as a primary lamp filling with Sb as a secondary filling, with both elements providing evidence of suitable energy potentials to that required for ionization to indicate the production of a wall stabilised arc. Te appears to provide suitable thermal and pressure (as $TeI_4$) characteristics to match Hg as the primary lamp filling. Te will provide a stable iodide at pre running conditions as $TeI_4$ which will be converted to $TeI_2$ in the gas phase. The only possible disadvantage identified in the assessment is that over 600° C. the Te iodide transitions back and forth to both Te and I (both of which are in the gas phase) and it is unknown whether this will cause any instability in the functioning of a lamp.

Review of Patented Technology Relating to the Use of Relevant Halides

The functional assessment of selected halides Te and Sb provided a basis for a potential high efficiency UV MH lamp. The methods of UV generation development can be linked to visible lighting and as such could be the reason for the lack of such a MH development (i.e. the visible Hg MH lamp would not benefit from replacing Hg). There is still an underlying question as to the reason for a lack of such a MH development to date when considering the developments of LP UV sources. As such an assessment of related patents filed is listed in Table 12 with relevant associated data displayed in FIGS. 12, 13 and 14.

TABLE 12

Patents relating to Te/Sb MH lamp

| | Elements Relating to Patent | Halogen(s) Used | Key Details of Patent |
|---|---|---|---|
| Pat1 | Antimony | Iodine | Aim: Development of a lamp for curing with target spectral range of 280-340 nm (FIG. 12) |

TABLE 12-continued

| Patents relating to Te/Sb MH lamp | | | |
|---|---|---|---|
| | Elements Relating to Patent | Halogen(s) Used | Key Details of Patent |
| | | | Concept lamp produces spectral output from 200-315 nm at 40% efficiency<br>Lamp construction as per a high pressure discharge lamp<br>Neon (40 mbar) or Xenon (250 mbar) as a buffer gas<br>Dosed Iodine between 0.070-0.119 mg cm−3<br>Dosed Antimony between 0.035-0.055 mg cm−3 |
| Pat2 | | Tellurium Tellurium + (Sulfur and Selenium) | Stated aim of design to have an increased efficiency compared to a HID lamp without using the 'toxic' fillings of Hg<br>Produces visible radiation (>400 nm) (FIG. 13)<br>Electrode and electrodeless operation<br>Tellurium filling dose (either as element or halide) minimum of 1017 molecules/cc to ensure predominant output in visible and not UV.<br>Tellurium halides proposed for use; TeCl5, TeBr5, TeI5<br>Variable power densities when using microwave driver (5 W/cc-1000+ W/cc)<br>Concept lamp (37 mm ID spherical bulb (26.5 cm3), 20 mg of Te, ~133 mbar Xenon) efficiency 105 lumens/W |
| Pat3 | Lithium, Indium, Tin, Antimony, Tellurium, Aluminium | Bromine and Iodine | Aim: Production of Extreme Ultraviolet Radiation (EUV) i.e. from 5-50 nm<br>Target 50 W to 100 W of EUV<br>All elements dosed as Halogen<br>Pressure of Halides provided (FIG. 11) |
| Pat4 | Arsenic, Phosphorous, Sulphur, Selenium and Tellurium (or combination) | Chlorine, Bromine, Iodine (or a mixture) | Displayed output between 150 nm and 400 nm with the majority being between 150 nm and 300 nm (FIG. 14)<br>No detailed information on design i.e. amounts of filling running characteristics |

Pat1 = Schafer, J. (1976) Metal halide discharge lamp for use in curing polymerizable lacquers, GB 1 552 334
Pat2 = Turner, B. (1994) Tellurium lamp, U.S. Pat. No. 5,661,365
Pat3 = Derra, G. and Nielman, U. (2003) Method of generating extreme ultraviolet radiation, EP1502485B1 and Derra, G. and Nielman, U. (2008) Method of generating extreme ultraviolet radiation, U.S. Pat. No. 7,385,211B2
Pat4 = Kaas, P. and Ebert, B. (2004) UV-optimised discharge lamp with electrodes, EP1463091A3

Figure 12:
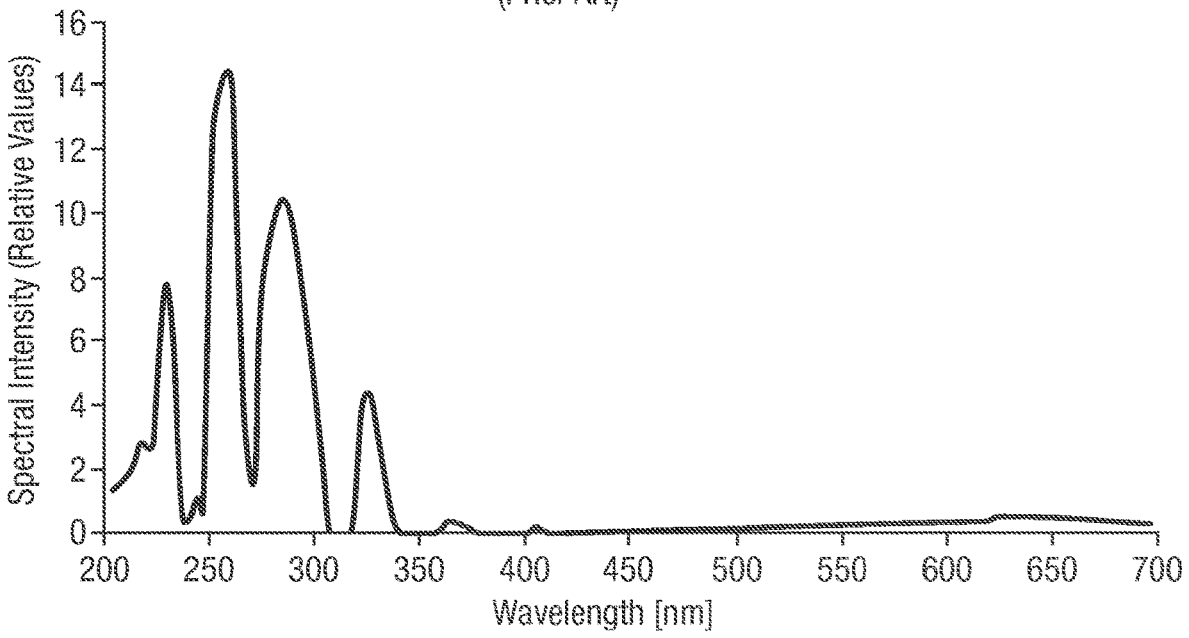
Fig. 12 (Prior Art)
FIG. 12 shows spectral output from a prior art concept antimony lamp.

FIG. 12 shows spectral output from a prior art concept antimony lamp, adapted from Pat1.

Figure 13:
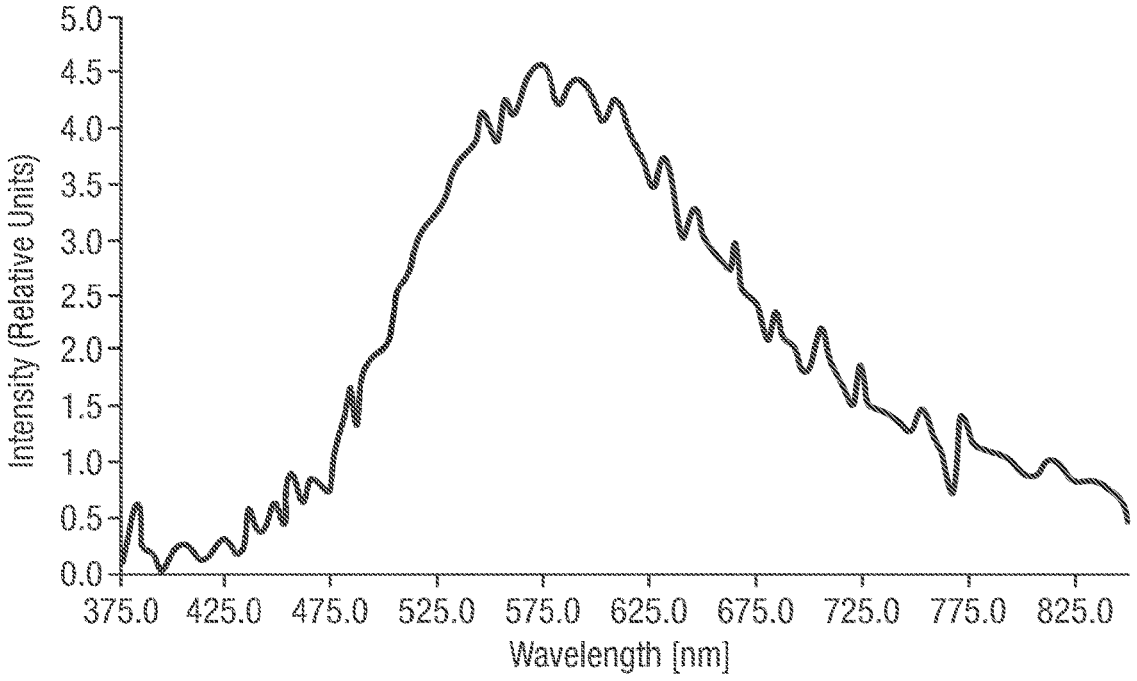
Fig. 13 (Prior Art)
FIG. 13 shows spectral output from a prior art tellurium concept lamp.

FIG. 13 shows spectral output from a prior art tellurium concept lamp, adapted from Pat2.

Figure 14:
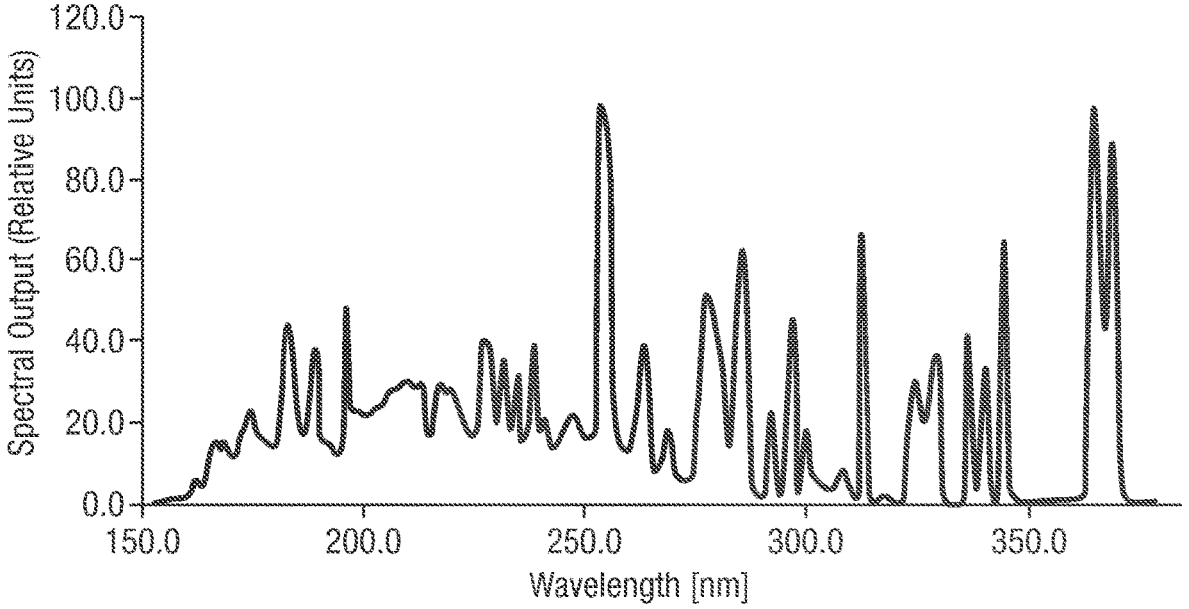
Fig. 14 (Prior Art)
FIG. 14 shows spectral output of another prior art lamp.

FIG. 14 shows spectral output of another prior art lamp, adapted from Pat4.

Pat1 using a Sb halide produces a significant amount of UV radiation (FIG. 12) in what could be described as a near ideal spectral output for the disinfection of water. The amounts of Sb halide used would not result in a LTE and a desired wall stabilised arc and thus not produce the desired high density lamp.

Pat4 shown in FIG. 14 shows similarities to the spectral output described in neutral Te displayed in FIG. 8. As Te in Pat4 is only one of a potential number of fillings which could be combined it is only indicative of the spectral potential for a Te-based lamp.

Pat3 provides further spectral data on the use of Te as a lamp filling for UV production.

Pat2 is the closest representative of a HP lamp using Te. The data provided in Pat2 (FIG. 13) is that for an electrode stabilised arc whereby the pressure used establishes a HP discharge but the spectral output is all in the visible spectrum. In contrast to the wall stabilised arc described earlier, a short arc length can be used to provide a stable arc i.e. an arc stabilise lamp where it is not possible for to obtain a stable plasma for a wall stabilised discharge. The dominance of the visible output described is expected with increasing pressure as per the MP discharge, however the quantities of Te described in lamp fillings are extremely low relative to an equivalent Hg lamp. This indicates either a potential limitation of the use of Te to produce a HP UV discharge or an error in the patent description. The patent does describe the addition of sulphur in some variants and thus this could explain any spectral error however it is unfeasible to establish a HP lamp with such low lamp fillings described.

In particular, Pat2 appears to recite features such as:

the radiation produced in excess of 400 nm use of TeI5 use of microwave energy

Although the concept of a Te based MH lamp seems technically feasible from a functional assessment, no high efficiency UV HP MH has been published to date or a plasma with a visible output using of tellurium iodide in a stoichiometric ratio of Te:I of 1:2, and therefore practical verification of this technical proposal is required.

The use of a halogen is required for the benefits in increased vapour pressure however as described above the possibility of I2 formation is high (because there is no Hg to form HgI2) and therefore the dosing of tellurium to iodide proportions as described in the previous paragraph is not only novel but likely critical to producing a functional UV MH lamp.

Summary of Critical Aspects Relating to Lamp Design Proposal

A UV MH lamp was deemed to be feasible based on a primary lamp of filling of Te and iodide in the form of $TeI_2$ and a secondary lamp filling of $SbI_3$. In optimised quantities this combination of lamp fillings were expected to enable similar internal lamp pressures to that of an Hg HP lamp but with increased spectral efficiency due to the second filling with a lower excitation level and optimal spectral characteristics. The benefits of Te in conjunction with iodine is that relatively similar pressure characteristic to Hg should be achieved however at the temperature produced in a HP lamp (>600° C.) an interchangeable state is formed between the iodide compound in gas phase and its elemental constituent in the gas phase, it is unknown whether the elemental components particularly $I_2$ with its high vapour pressure will affect the stability and functionality of the lamp. Excluding this, the suitability of both Te and Sb iodides to provide a functional alternative to Hg as a HD UV source looks technically promising however optimal quantities need to be practically assessed.

Practical Details of Design Proposal

To achieve the proposed concept of a high efficiency MH HP lamp with Te Halide forming the primary constituent of lamp plasma and Sb iodide as a secondary filling maximising the spectral output in the UVC region a number of design stages had to be undertaken. These are described below:

Stage1—

Initial requirements are to establish the functionality and performance criteria of tellurium iodide as lamp plasma, particularly in respect to; arc stability, electrical characteristics during running, spectral output and spectral radiant efficiency.

This was achieved by using TeI4 and Te as the lamp fillings in a stoichiometric ratio of 2:1 (I:Te). Two initial lamp fillings with two lamp body geometries (15 mm Internal Diameter (ID) and 18 mm ID both with a 100 mm Arc Length AL) will be used to gain initial performance data. The 18 mm ID lamp geometry is more representative of a conventional MP lamp however the 15 mm ID geometry reduces the possibility of halide condensation particularly in maintaining the gas phase of tellurium iodide i.e. >400-600° C.

Stage 2—

Optimise the quantities of Te Iodide to provide optimal performance criteria using Hg MP lamp as a baseline. This will require balancing the spectral performance of the unit to power density whilst assessing arc stability. Assuming arc stability there may well be a balance between spectral optimisation depending on the two key areas i.e. 200-230 nm and 260-280 nm and pressure, and lamp pressure i.e. power density, hence this could lead to two separate designs to be optimised by Stage 3.

Stage 3—

Addition of Sb iodide to optimised Te iodide primary filling. Based on Hg based MH lamps only a small percentage will be required however this is not guaranteed and so a range of Sb iodide fillings should be used starting at 5% of the Te iodide value.

Prototype Specifications

As initial guidance for stage 1 the following values were determined. Using total weight as a comparative value the lower values (those of half the quantity used in the prototype by Turner (1994)) in Table 13 with lamp geometries selected being in the region used for current HP Hg lamps (18 mm ID prototype lamps). Following the assessment of the results of these prototypes in respect of spectral output, spectral efficiency and visual verification of lamp performance (e.g. arc position and stability) optimisation of lamp fillings can proposed for Stage 2.

TABLE 13

Initial Te Prototype Specification

| | Half Te value from Turner (1994) Prototype | Te value from Turner (1994) Prototype |
|---|---|---|
| mg of Te for 15 mm prototype (15 mm ID * 100 mm Arc length) | 6.6 | 13.2 |
| mg Te + TeI4 for 15 mm TeI2 Prototype[#1] | 19.8 | 39.6 |
| mg Te for Prototype | 3.3 | 6.6 |
| mg TeI4 for Prototype | 16.5 | 33.0 |
| mg of Te for 18 mm prototype (18 mm ID * 100 mm Arc length) | 9.5 | 19.1 |
| mg Te + TeI4 for 18 mm TeI2 Prototype | 28.5 | 57.0 |
| mg Te for Prototype | 4.75 | 9.55 |
| mg TeI4 for Prototype | 23.65 | 47.50 |

[#1]Hg fill for concept lamp based on maximum loading whilst enabling a stable arc = 12 V cm−1. Hg dose for 15 mm prototype estimated voltage cm−1 = 25 mg and 18 mm prototype = 40 mg

TABLE 14

Details of the comparative Hg lamps considered

| Lamp Name | Hg (mg) | Argon (mbar) | Physical Requirements |
|---|---|---|---|
| 15 mm ID Hg lamp | 25 | 25 | Large Hanovia electrodes + Standard quartz with 1.5 mm wall thickness |
| 18 mm ID Hg lamp | 40 | 25 | Large Hanovia electrodes + Standard quartz with 1.5 mm wall thickness |

Methodology

All the prototype lamps were produced by Hanovia Ltd (Berkshire, UK). The Hg lamps were produced as per the standard manufacturing process to the author's specification (Table 14). All lamp bodies (lamps without fillings) produced for the metal halide prototypes were produced using the same production process as the Hg lamps until the point of inserting the lamp fillings, at which point the lamps were removed from the process whilst under vacuum using Swagelok (Hertfordshire, UK) vacuum fittings and were transferred into a Mbraun (Nottinghamshire, UK) Unilab Plus glovebox enabling a moisture and oxygen free environment (<0.5 ppm of measured $H_2O$ and $O_2$). In these conditions the required lamp fillings were weighed using a VWR (Leicestershire, UK) precision balance with automatic calibration (SN: LPW-723i) sensitive to 1 mg. Fillings were added to the lamp bodies, re-sealed and returned to the standard lamp production process. All prototypes had platinum reflective paint to the rear of the electrodes to reflect infrared ER, preventing a cold spot forming behind the electrodes and the potential for condensation of lamp fillings from the lamp plasma.

Performance Assessment

The performance assessment was carried out in terms of three specific aspects; Physical characteristics (i.e. arc stability), Absolute spectral output and Electrical characteristics. All prototypes were driven with an Eta+ (Nuertingen, Germany) X series electronic ballast with a 4 kW power rating. If the prototype did not ignite it was cooled (this is stated in Table 16 in the comment section if cooling was required) using freezer spray (Artic Products, Leeds UK or Electrolube, Leicestershire, UK) to reduce the internal gas pressure and consequently the strike voltage. This was generally due to halide dissociation during manufacturing process e.g. the lamp temperature increasing due to the removal of the lamp stem (used to inset lamp fillings and gas).

The details of the lamp assessment are described below:

Physical Characteristics—

The first lamp of each prototype design was conducted in front of a viewing window (comprised of welding glass) to enable the viewing of the lamp when running the arc. Photographic images of the lamps running were taken through the viewing window using a Fujifilm (Fujifilm UK, Bedford, UK) s9600 bridge camera.

Spectral and Electrical Characteristics—

The lamps were operated horizontally in air in a dark room with the lamp radiation passing through a collimating tube (500 mm in length with internal baffles for collimation) with vertical entrance slit of 0.51 mm in width. When the lamp had stabilised, electrical characteristics were measured with a Voltech (Oxfordshire, UK) PM6000 3 phase universal power analyser. Germicidal efficiency was calculated from the spectral measurements accounting for the shaded slit width (0.53 mm), the measured distance from the lamp arc (0.5 m) and the Arc length (0.1 m) and correcting for germicidal weightings. Two action spectra (AS) were used to calculate germicidal weightings: Spectrum B representing a target pathogen with no sensitivity below 230 nm, and Spectrum A representing a target pathogen with a high sensitivity below 230 nm. The AS used were adapted so relative values equalled one at 253.7 nm.

Figure 15:
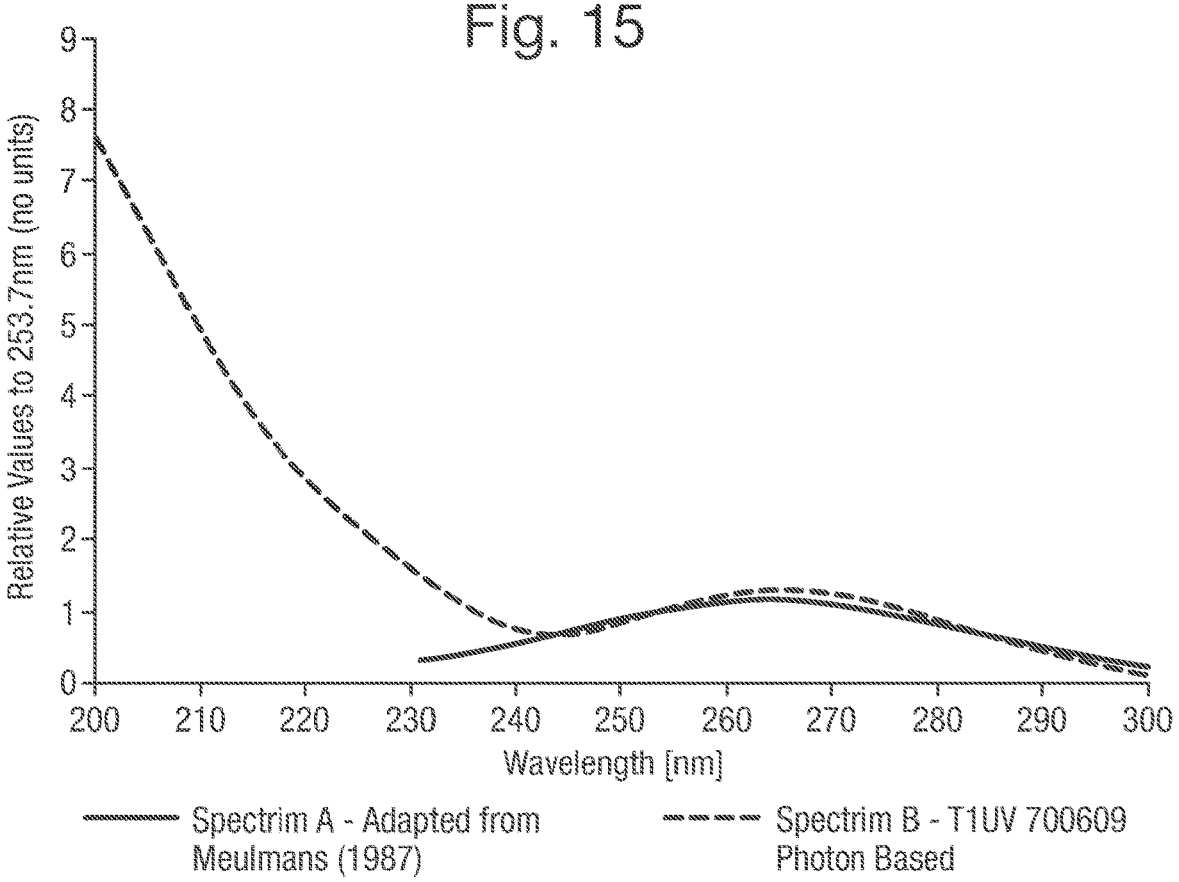
FIG. 15 shows germicidal weightings for determination of lamp germicidal efficiencies.

FIG. 15 shows germicidal weightings for determination of lamp germicidal efficiencies Results Prototype Development During the production of the initial set of halide prototypes for design stage 1 an error was made during dosing of the lamps meaning that the amount of Te dosed was ten times higher than that desired in Table 13, with the final amounts for all subsequent design stages therefore provided in Table 15. In addition, two practical challenges emerged: the weighing of lamp fillings (determined to be due to a gas leak which as a consequence produced varying pressure during measurements, this was resolved for the second and third set of prototypes) and the process of de-stemming in the lamp production process (due to a marginal stem size increase to 6 mm for vacuum fittings, this was resolved through removal of the stem in stages to allow closure more gradually).

TABLE 15

| Finalised lamp fillings for halide prototypes | | | |
|---|---|---|---|
| Lamp Name | Te (mg) | TeI4 (mg) | SbI3 (mg) |
| 1st Set of Prototypes | | | |
| 15 mm Lamp I | 33 | 17 | 0 |
| 15 mm Lamp II | 66 | 33 | 0 |
| 18 mm Lamp I | 48 | 24 | 0 |
| 18 mm Lamp II | 96 | 48 | 0 |
| 2nd Set of Prototypes | | | |
| 15 mm Lamp III | 40 | 19 | 0 |
| 15 mm Lamp IV | 70 | 35 | 0 |
| 15 mm Lamp V | 100 | 20 | 0 |
| 18 mm Lamp III | 50 | 25 | 0 |
| 18 mm Lamp IV | 100 | 50 | 0 |
| 18 mm Lamp V | 150 | 25 | 0 |
| 3rd Set of Prototypes | | | |
| 15 mm Lamp VI | 20 | 4 | 5 |
| 15 mm Lamp VII | 100 | 20 | 21 |
| 18 mm Lamp VI | 20 | 10 | 5 |
| 18 mm Lamp VII | 100 | 50 | 21 |

The practical problems described in the construction of stage 1 prototypes led to a significantly reduced number of functioning prototypes (Table 16) and thus the decision was made to use the increased proportional Te levels for design stage 2, due to the desirable lamp voltage (i.e. near 12V $cm_{-1}$) produced by 18 mm Lamp I B and 15 mm Lamp II B. This meant that although slightly adjusted (due to the simplicity of not requiring balanced Te and I levels) the prototypes from stage 1 were re-built (Lamps III and IV) and tested with a third variant (Lamp V) with a reduced proportion of $TeI_4$ to Te but with a combined high quantity of filling to attempt to produce a lamp with higher voltage. Following the completion of the second set of prototypes the lamp with the highest spectral output for both 18 mm (Lamp VI) and 15 mm (Lamp V) lamps was selected as the basis for stage 3 development. In addition, to identify the cause behind the similarities in lamp voltage produced a second set of lamp designs was produced with reduced fillings using one-fifth of the quantities of lamp fillings in stage 2. All lamp fillings are specified for stages 1, 2 and 3 prototypes and are displayed in Table 15.

Performance Evaluation

The performance results from all 3 prototype stages are provided below in Tables 16 with related images to aid performance assessment being subsequently provided in FIGS. 16, 17,18 and 19.

TABLE 16

| Performance details | | | | | | |
|---|---|---|---|---|---|---|
| Hg Lamps | | | | | | |
| Lamp Details | Mean Voltage (V) | Mean Current (A) | Mean Power (W) | 200-300 nm (Integrated Scan Value W m−2) | Germ A % 85 | Germ B % |
| Hg 18 mm Lamp A86 | — | — | — | — | — | — |

TABLE 16-continued

| Performance details | | | | | | |
|---|---|---|---|---|---|---|
| Hg 18 mm Lamp B | 122 | 5.67 | 657 | 10.2 × 102 | 6.6 | 13.4 |
| Hg 18 mm Lamp C | 120 | 5.72 | 652 | 10.3 × 102 | 6.6 | 13.7 |
| Hg 18 mm Lamp D | 118 | 5.78 | 649 | 10.9 × 102 | 7.2 | 14.4 |
| Hg 15 mm Lamp A | — | — | — | — | — | — |
| Hg 15 mm Lamp B | 118 | 5.79 | 651 | 10.9 × 102 | 7.3 | 13.7 |
| Hg 15 mm Lamp C | 117 | 5.89 | 651 | 11.3 × 102 | 7.5 | 14.3 |
| Hg 15 mm Lamp D | 119 | 5.79 | 655 | 10.9 × 102 | 7.3 | 13.4 |

| Hg Lamps | |
|---|---|
| Lamp Details | Comments |
| Hg 18 mm Lamp A[#2] | The lamp struck easily and ran well producing a clear arc (FIG. 16a) however the left arc (from the viewer's position) is raised higher than would be desired and may be indicative of nearing the transition to turbulence and raising of the arc |
| Hg 18 mm Lamp B | Ran smoothly |
| Hg 18 mm Lamp C | Ran smoothly |
| Hg 18 mm Lamp D | Ran smoothly |
| Hg 15 mm Lamp A | The lamp produced a very clean straight arc with the only slight instability being that of the arc forming slightly to the back of the electrodes rather than directly off the tip. |
| Hg 15 mm Lamp B | Ran smoothly |
| Hg 15 mm Lamp C | Ran smoothly |
| Hg 15 mm Lamp D | Ran smoothly |

[#2]All lamps visually assessed based on a single set of Electrical measurements only.

FIG. 16 show images from a set of benchmark mercury lamps.

Figure 16A:
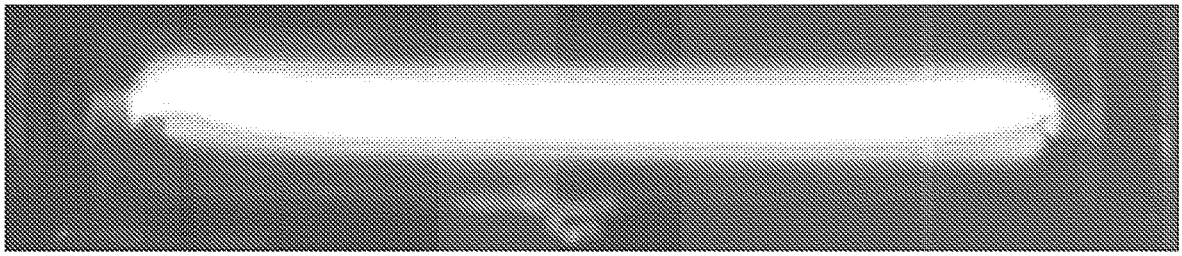
FIGS. 16(*a*) and 16(*b*) show images from a set of benchmark mercury lamps.
Figure 16B:
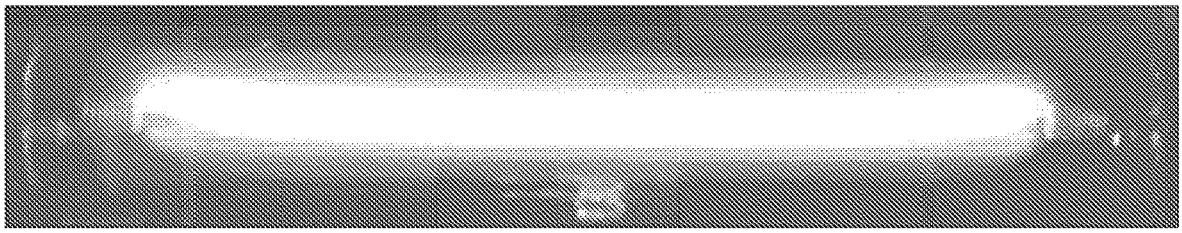

FIG. 16*a* shows Mercury lamp 18 mm Lamp A.
FIG. 16*b* shows Mercury lamp 15 mm Lamp A.

| 1st Set of Lamp Prototypes | | | | | | |
|---|---|---|---|---|---|---|
| Lamp Details | Mean Voltage (V) | Mean Current (A) | Mean Power (W) | 200-300 nm (Integrated Scan Value W m−2) | Germ A %[#3] | Germ B % |
| 18 mmm ID Lamp I A | — | — | — | — | — | — |
| 18 mmm ID Lamp I B | ~80 | — | — | — | — | — |
| 18 mmm ID Lamp II A | — | — | — | — | — | — |
| 18 mmm ID Lamp II B | — | — | — | — | — | — |
| 15 mmm ID Lamp I A | — | — | — | — | — | — |
| 15 mmm ID Lamp I B | — | — | — | — | — | — |
| 15 mmm ID Lamp I A | — | — | — | — | — | — |
| 15 mmm ID Lamp II B | 95.7 | 7.7 | | | — | — |

[#3]Germ A % and Germ B % relates to the germicidal efficiency of the lamps when weighted with action displayed in FIG. 15.

Figure 17A:
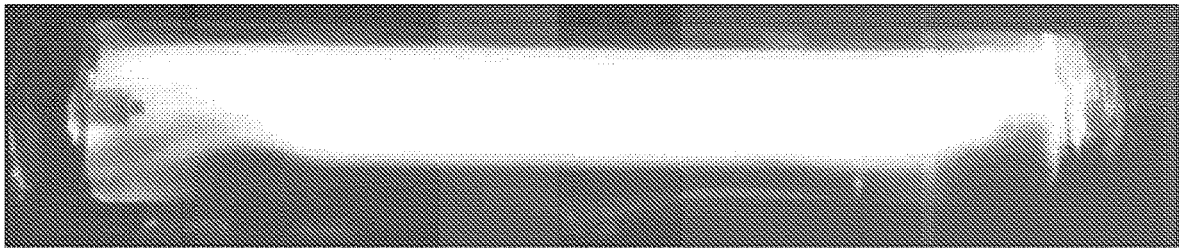
FIGS. 17(*a*) and 17(*b*) show images from a first set of halide prototype lamps.

| 1st Set of Lamp Prototypes | |
|---|---|
| Lamp Details | Comments |
| 18 mmm ID Lamp I A | Did not complete production |
| 18 mmm ID Lamp I B | The lamp struck easily initially with an erratic arc particular around both electrodes however as the arc continued to develop it stabilised in the mid-section of the lamp producing a wide arc (FIG. 17a). This is supportive of the change from the prediction initial TeI4 gas phase transitioning to TeI2 using the additional Te dosed separately into the lamp. After lamp warm up the left electrode still exhibited turbulence with the arc fluctuating from the lower to upper side of the electrode with a notable pocket of iodide vapour circulating around the electrode tip. The arc produced in the centre of the lamp is of a clear discharge, not displaying any elemental iodine and being a relatively wide arc i.e. not particularly contracted. This could be indicative of a wall stabilised arc rather than the desired contracted arc associated with HP discharges. |
| 18 mmm ID Lamp II A | Did not complete production |
| 18 mmm ID Lamp II B | Did not strike |
| 15 mmm ID Lamp I A | Was not Run |
| 15 mmm ID Lamp I B | Was not Run |
| 15 mmm ID Lamp I A | Was not Run |
| 15 mmm ID Lamp II B | Slight dispersion of halides from stem removal process requiring freezer spray to start. Considerable change in lamp arc during warm up (FIG. 17b) which display a relatively straight arc to that of a turbulent arc. |

FIG. 17 show images from a first set of halide prototype lamps.

FIG. 17*a* shows Lamp 18 mm IIB.

Figure 17B:
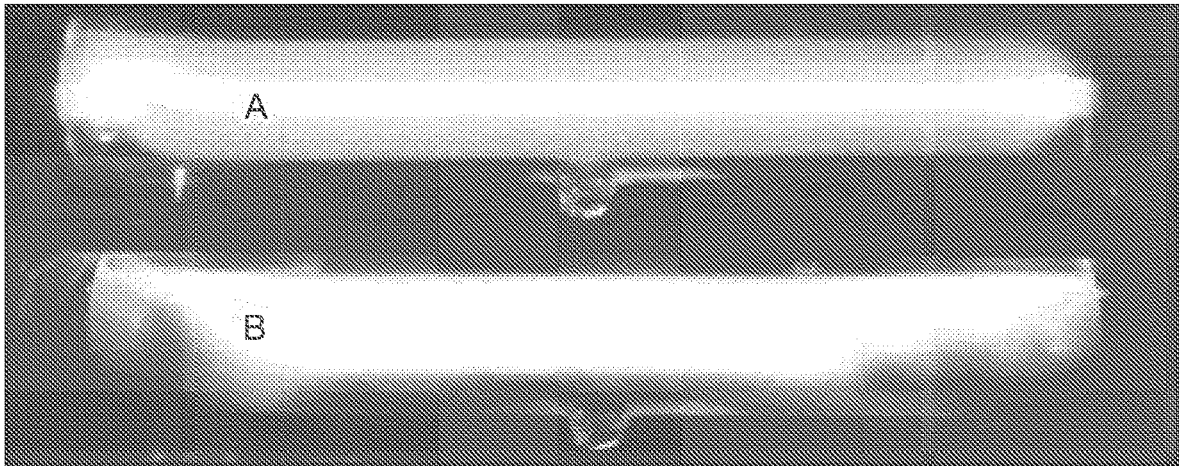

FIG. 17*b* shows Lamp 15 mm IIB. (Image A (Top) taken during the warm up stages of the lamp and Image B (Bottom) taken when the lamp had warmed up)

| 2nd Set of Lamp Prototypes | | | | | | |
|---|---|---|---|---|---|---|
| Lamp Details | Mean Voltage (V) | Mean Current (A) | Mean Power (W) | 200-300 nm (Integrated Scan Value W m−2) | Germ A % 85 | Germ B % |
| 18 mm ID Lamp III A | 85 | 9.12 | 599 | 6.2 × 10−3 | 0.4 | 0.5 |
| 18 mm ID Lamp III B | 88 | 8.9 | 580 | — | — | — |
| 18 mm ID Lamp IV A | 92 | 8.15 | 660 | 8.9 × 10−3 | 0.6 | 0.7 |
| 18 mm ID Lamp IV B | | | | | | |
| 18 mm ID Lamp V A | 81 | 9.95 | 603 | 6.65 × 10−3 | 0.4 | 0.6 |
| 18 mm ID Lamp V B | 80 | 10 | 600 | | | |
| 15 mm ID Lamp III A | 93 | 8.15 | 616[#4] | 9.2 × 10−3 | 0.6 | 0.7 |
| 15 mm ID Lamp III B | | | | | | |
| 15 mm ID Lamp IV A | 95 | 7.6 | 605 | 10.45 × 10−3 | 0.7 | 0.8 |
| 15 mm ID Lamp IV B | | | | | | |
| 15 mm ID Lamp V A | 95 | 7.7 | 606 | 11.05 × 10−3 | 0.8 | 0.9 |
| 15 mm ID Lamp V B | 90 | 8.3 | 575 | — | — | — |

[#4]The first set of electrical measurements from the second spectral scan was missing therefore 2nd set from first scan was used due to the short period of time between the scans 2nd Set of Lamp Prototypes

Figure 18A:
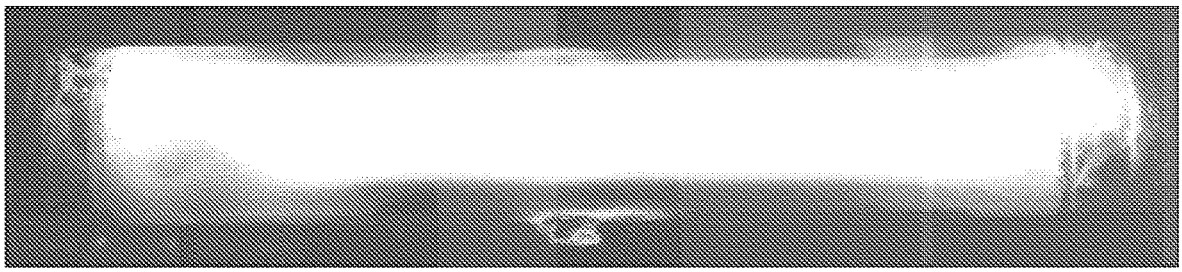
FIGS. 18(*a*), 18(*b*) and 18(*c*) show images from a second set of halide prototypes.
Figure 18B:
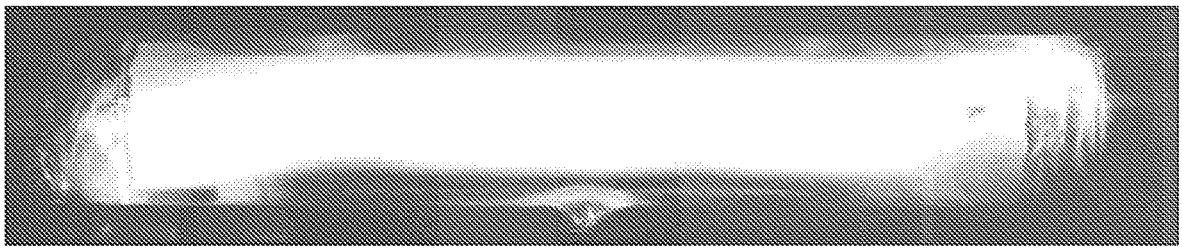

| Lamp Details | Comments |
|---|---|
| 18 mm ID Lamp III A | Erratic arc which could affect the spectral measurements taken for this lamp and all those similar. |
| 18 mm ID Lamp III B | Arc has some periods of stability however for the vast majority of time there is a great amount of instability particularly in the left electrode (FIG. 18a). As with lamp 15 mm IIB a clear distinction can be made between the lamp characteristics during the warm up phase where a contracted largely stable arc with lower visible output can be distinguished from that of the turbulent arc displayed post lamp warm up. Additionally it can be noted that after the warm up phase 'gas pockets' of an orange colour (presumably iodine) collect around the electrodes and that a dark area is noticeable on the underside of the arc. (Lamp was run for approximately 15 minutes) |
| 18 mm ID Lamp IV A | Minor dispersion of halide from stem removal process. Oscillating arc around the electrodes. |
| 18 mm ID Lamp IV B | Did not run, even with freezer spray applied. |
| 18 mm ID Lamp V A | Slightly slower to start compared to other halide prototypes |
| 18 mm ID Lamp V B | Large dispersion of halide from stem removal process. Lamp ran well with less turbulence and less visible 'gas pockets' around electrodes (FIG. 18b). Lamp ran for approximately 25 minutes and based on visible attributes would be an ideal candidate to take forward to the next stage of development. |
| 15 mm ID Lamp III A | Erratic arc on left electrode. |
| 15 mm ID Lamp III B | Minor dispersion of halide from stem removal process. |
| 15 mm ID Lamp IV A | Erratic arc at electrodes but stable in central area between electrodes. |
| 15 mm ID Lamp IV B | Did complete production |
| 15 mm ID Lamp V A | Although erratic at lamp ends there were less visible signs of 'gas pockets' around the electrodes. Lamp more stable a full power. |
| 15 mm ID Lamp V B | Some dispersion of halide on lamp, freezer spray required to strike lamp. Relatively stable lamp voltage in comparison to halide prototypes. Occasional bright spots within the arc lasting approximately 1 second (possibly elemental tellurium). Instability at electrodes at both sides (FIG. 18c). |

FIG. 18 show images from a second set of halide prototypes

FIG. 18*a* shows Lamp 18 mm IIIB

FIG. 18*b* shows Lamp 18 mm VB

Figure 18C:
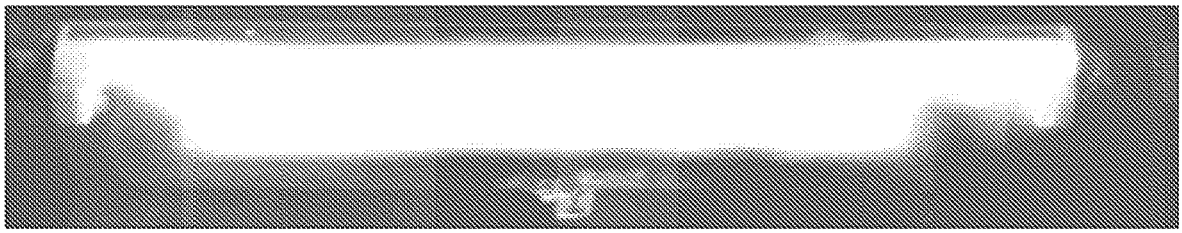

FIG. 18*c* shows Lamp 15 mm VB

3rd Set of Lamp Prototypes

| Lamp Details | Mean Voltage (V) | Mean Current (A) | Mean Power (W) | 200-300 nm (Integrated Scan Value W m−2) | Germ A % 85 | Germ B % |
|---|---|---|---|---|---|---|
| 18 mm ID Lamp VI A | 90 | 8.6 | 604 | | | |
| 18 mm ID Lamp VI B | 87 | 8.9 | 614 | $5.2 \times 10^{-3}$ | 0.4 | 0.5 |
| 18 mm ID Lamp VI C | 79 | 10.1 | 597 | $5.77 \times 10^{-3}$ | 0.4 | 0.6 |
| 18 mm ID Lamp VII A | 95 | 7.6 | 604[#5] | $2.44 \times 10^{-3}$ | 0.2 | 0.2 |
| 18 mm ID Lamp VII B | 100 | 7.1 | 621 | $1.67 \times 10^{-3}$ | 0.1 | 0.1 |
| 18 mm ID Lamp VII C | 100 | 7.1 | 632 | — | — | — |
| 15 mm ID Lamp VI A | 88 | 8.8 | 612 | — | — | — |
| 15 mm ID Lamp VI B | 102 | 6.9 | 612 | $4.27 \times 10^{-3}$ | 0.3 | 0.4 |
| 15 mm ID Lamp VI C | 89 | 8.7 | 617 | $6.33 \times 10^{-3}$ | 0.5 | 0.7 |
| 15 mm ID Lamp VII A | 95 | 7.0 | 559 | — | — | — |

-continued

| 3rd Set of Lamp Prototypes | | | | | | |
|---|---|---|---|---|---|---|
| Lamp Details | Mean Voltage (V) | Mean Current (A) | Mean Power (W) | 200-300 nm (Integrated Scan Value W m−2) | Germ A % 85 | Germ B % |
| 15 mm ID Lamp VII B | 94 | 8.0 | 623 | 6.67 × 10−3 | 0.5 | 0.6 |
| 15 mm ID Lamp VII C | 102 | 6.9 | 626 | 1.97 × 10−3 | 0.1 | 0.1 |

[#5]The first of four electrical measurements missing hence only one set of measurements was used for power calculation of the first spectral scan

| 3rd Set of Lamp Prototypes | |
|---|---|
| Lamp Details | Comments |
| 18 mm ID Lamp VI A | Freezer spray required to start the lamp. Significant turbulence around the electrodes affecting the stability of the arc (FIG. 19a) |
| 18 mm ID Lamp VI B | Erratic voltage and arc. |
| 18 mm ID Lamp VI C | Freezer spray used to start lamp. Arc rotated around the axis of the electrode. |
| 18 mm ID Lamp VII A | Erratic arc in proximity to the electrodes however by the second spectral scan arc had stabilised and likely the most stable arc following lamp warm-up that has been observed. Some slight red dots observed above electrodes for short periods of time~1 second. |
| 18 mm ID Lamp VII B | |
| 18 mm ID Lamp VII C | Freezer spray required to start lamp. Initial photo (FIG. 19b) taken at~75 V displaying the desirable characteristics produced previously in Lamp 15 IIB. Following the lamp strike and start up the lamp rapidly obtained the initial~75 V running voltage then after a number of minutes the voltage increased to its maximum running voltage where the distinction between arc characteristics can be seen. In its final running conditions the lamp displayed an exaggerated (compared to earlier lamps e.g. 18 mm IIIB) dark area below the arc stretching from the electrodes. |
| 15 mm ID Lamp VI A | Freezer spray required to start lamp. A very clean arc during lamp start up (FIG. 19c) that displayed near perfect characteristics. This transitioned into a relatively unstable arc after lamp warm-up. |
| 15 mm ID Lamp VI B | Freezer spray required to start the lamp |
| 15 mm ID Lamp VI C | Freezer spray required on to start the lamp. Occasional red spots observed near electrodes during the running of the lamp. |
| 15 mm ID Lamp VII A | Freezer spray required to start the lamp. During lamp warm up (FIG. 19d) an excellent arc was produced (with a straight line and low visible output (potentially indicative of a more desirable UV output) |
| 15 mm ID Lamp VII B | Erratic arc following lamp warm-up |
| 15 mm ID Lamp VII C | — |

FIG. 19 show images from a third set of halide prototypes

Figure 19A:
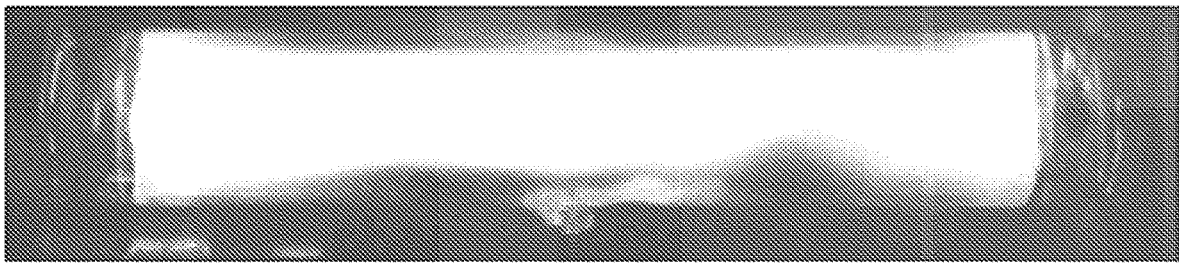
FIGS. 19(*a*), 19(*b*), 19(*c*) and 19(*d*) show images from a third set of halide prototypes.

FIG. 19*a* shows Lamp 18 mm VIA.

Figure 19B:
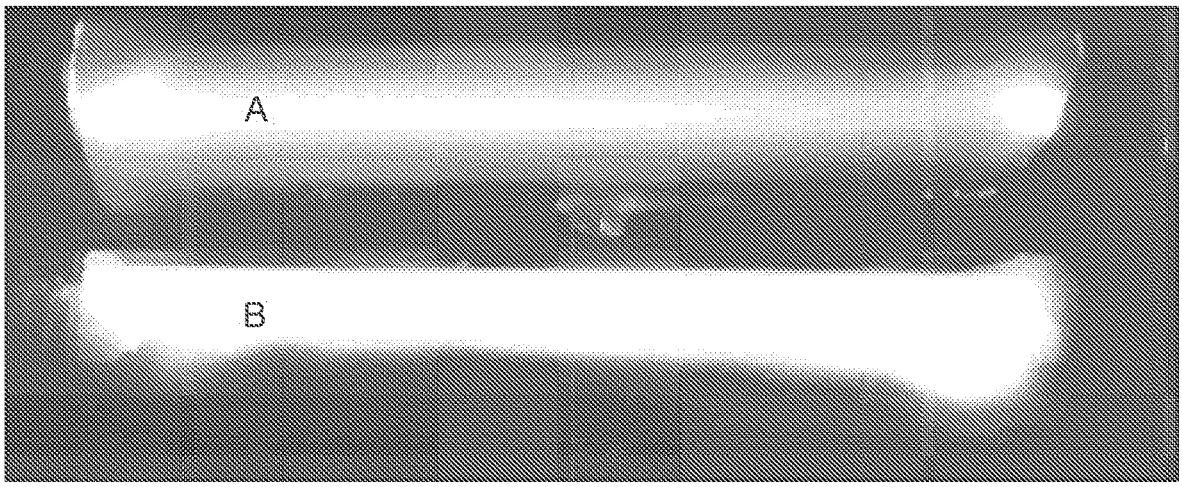

FIG. 19*b* shows Lamp 18 mm VIIC. (Image A (Top) taken during the warm up stages of the lamp and Image B (Bottom) taken when the lamp had warmed up)

Figure 19C:
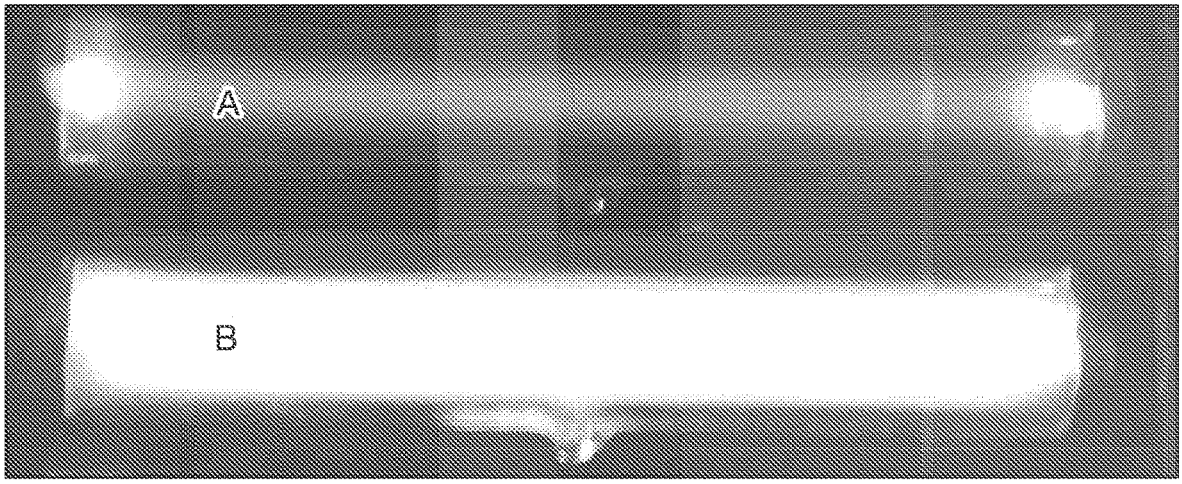

FIG. 19*c* shows Lamp 15 mm VIA.

Figure 19D:
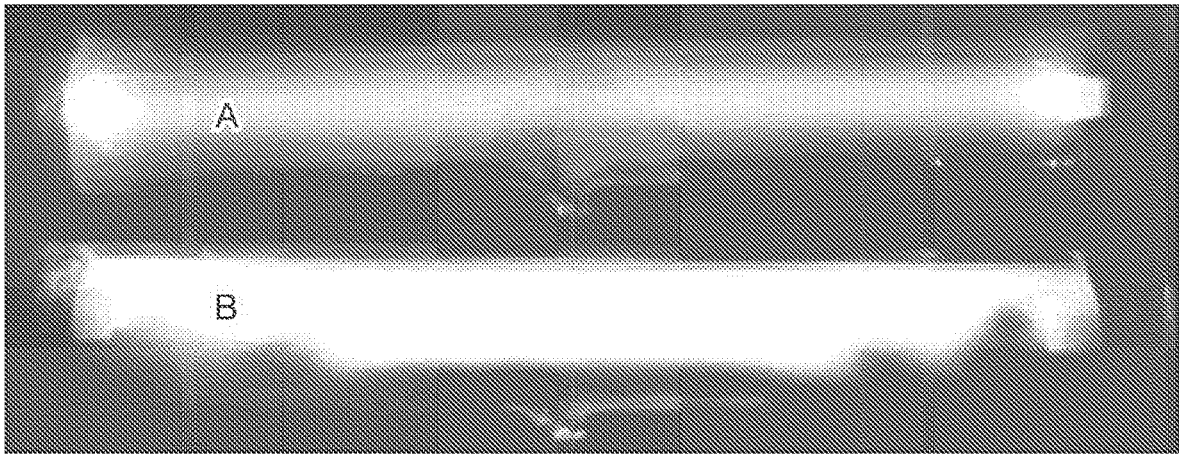

FIG. 19*d* shows Lamp 15 mm VIIA. (Image A (Top) taken during the warm up stages of the lamp and Image B (Bottom) taken when the lamp had warmed up)

Benchmark Hg Lamps—

The Hg based comparison lamps were made in a well-established process and were thus relatively simple to produce. The electrical performance of the lamps was extremely close and consistent (no greater then +/−3V) to that of the designed running voltage (120V). The lamps themselves ran well in respect of starting and stability with observed centralised arcs in both the 18 mm lamps (FIG. 16*a*) and the 15 mm lamps (FIG. 16*b*). There were indications (particularly on the left side of lamp) of the arc rising, suggesting that as per the design lamp voltage this is the maximum useable power density and consequently efficiency a Hg based high pressure will deliver, thus making it an ideal benchmark. That being said, the lamps delivered only 6.6-7.5% germicidal efficiency (based on Action Spectrum A) compared to the published values in the region of 12-16% indicating significant contrast to generalised values but enabling a direct like-for-like comparison of Hg HP lamps to that of the prototypes produced in stages 1, 2 and 3 below.

Figure 20:
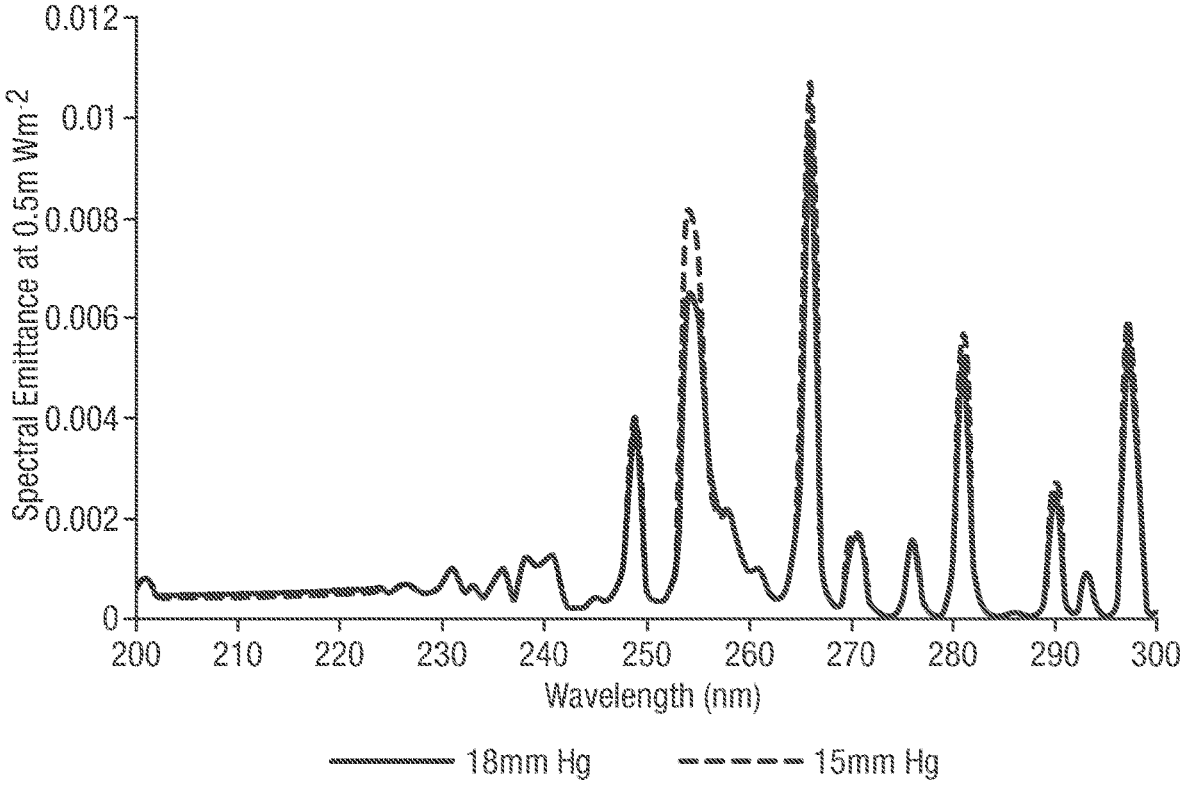
FIG. 20 shows the mean spectral output of benchmark mercury lamps.

FIG. 20 shows the mean spectral output of the benchmark mercury lamps.

The lamps both 15 mm and 18 mm provide a spectral output (FIG. 20) that would be expected for such an internal mercury pressure, although reduced spectral peaks are observed for the 18 mm lamps which could be due to additional absorption from the increased diameter correlating with a reduced germicidal efficiency (Table 16).

FIG. 21 show the mean spectral output of various prototype lamps.

Stage 1—

The two initial prototypes illustrated that a lamp with a sustained plasma can be produced and run for a period of a least 20 min (the time limited by the need to carry out further scans rather than issues with the lamp), a voltage density of 9.57 V $cm_{-1}$ can be produced (close to the comparative 12V $cm_{-1}$ of the benchmark Hg lamps), and a non-stoichiometric Te and I lamp filling can be used to produce a functional plasma. The lamps that did not start could be visually identified as having halide dispersion near the stem removal which in conjunction with the fact that the lamps were unable to restart indicates the separation at least in part of the halogen into its elemental form.

Stage 2—

The functional yield of the second set of prototypes was increased to 75% largely due to improvements in lamp stem removal. This also enabled identification of halide residual in the lamp stem and lamp positioning post stem removal as the causes of the 25% of the failures. Lamps III, IV and also lamp V (containing a reduced percentage of TeI4 to Te) produced voltages in a narrow region between 85-95V. There was a marginal increase in voltage from lamp III to lamp IV for the 18 mm lamps however the difference was negligible between the lamps of 15 mm. The production of similar voltages rather than an expected change proportional to the amount of lamp filling used could indicate either a restriction of Te entering the gas phase cause by non-stoichiometric quantities of lamp fillings, or saturation of lamp filling in the gas phase, i.e. increasing the lamp filling will not result in further fillings entering the gas phase and a proportional increase in lamp voltage (hence the production of second lamp design with significantly reduced fillings in stage 3).

Figure 21A:
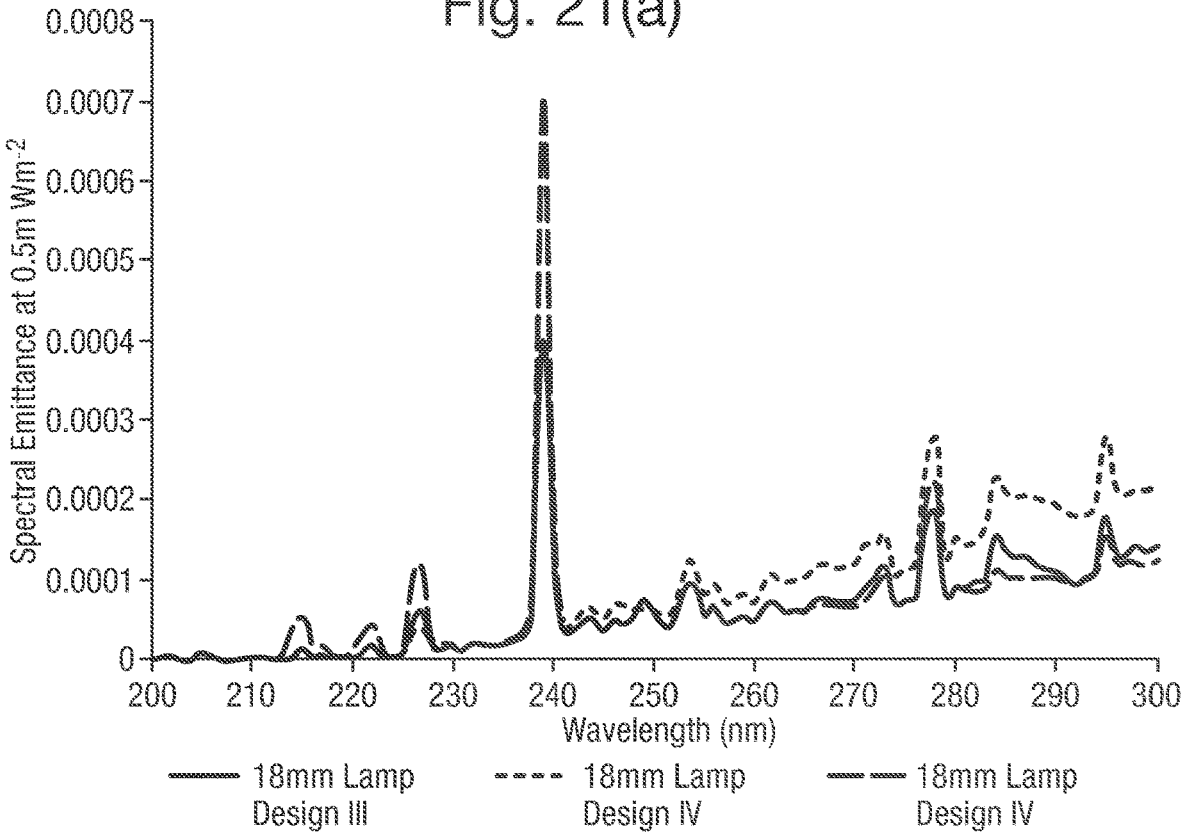
FIGS. 21(*a*), 21(*b*), 21(*c*) and 21(*d*) show the mean spectral output of various prototype lamps.

FIG. 21*a* shows the mean spectral output of 18 mm diameter prototype lamps of design III, IV and V.

Figure 21B:
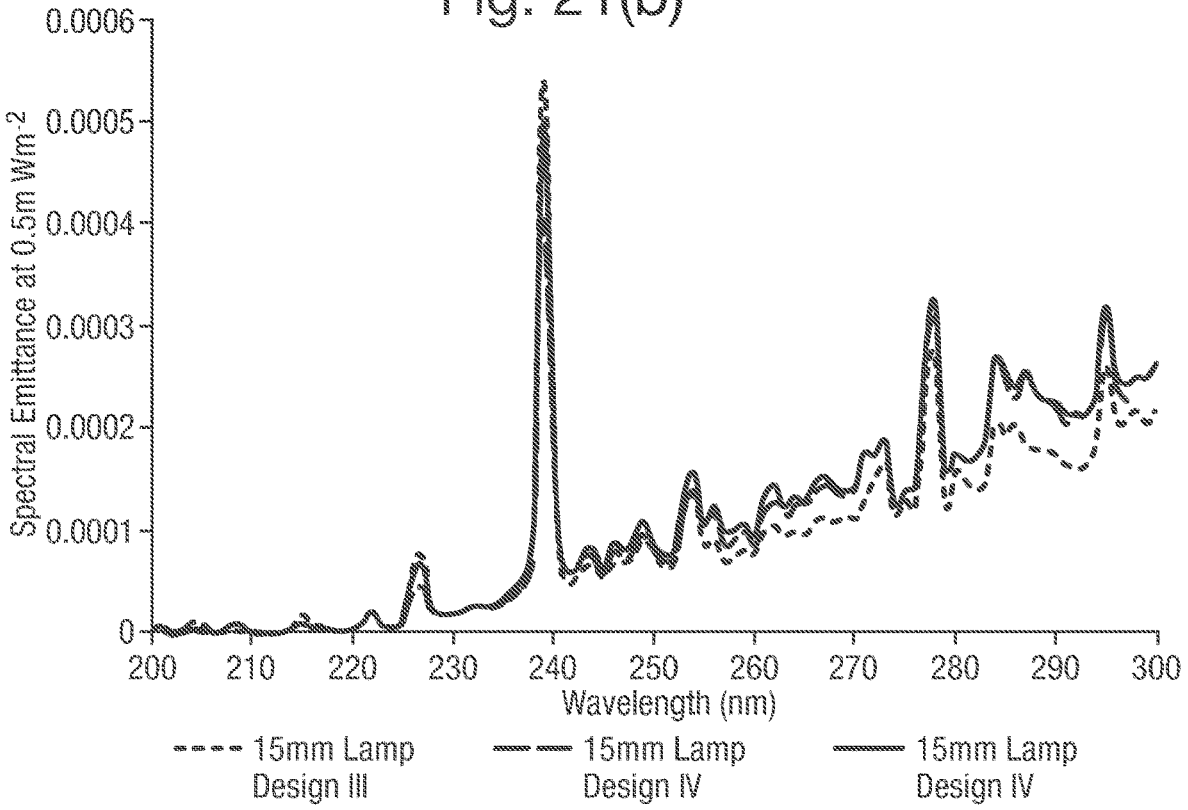

FIG. 21*b* shows the mean spectral output of 15 mm diameter prototype lamps of design III, IV and V.

The germicidal efficiencies of the stage 2 prototypes were significantly lower than the design target, ranging from 0.4-0.9% (depending on lamp and germicidal weighting). This can in part be attributed to the spectral output produced for both 18 mm (FIG. 21*a*) and 15 mm lamps (FIG. 21*b*) which is minimal at 220 nm and displays a gradual increase towards 300 nm.

Although this is not an ideal spectral output it is approximately one-tenth that of the Hg equivalent lamp and thus further losses must be occurring elsewhere in the lamp; the lamp driver being a contributory factor is ruled out due to the use of the measured power factor in power calculations which measured to the lamp (not inclusive of PSU losses). Noticeable features of both prototype sets 1 and 2 are the bright arcs displayed images indicating a high visible or output other than 200-300 nm and also the 'gas pockets' particularly visible near the electrodes with considerable convection currents being displayed. These latter points could be indicative of losses through unintended photon emission (not in the UV region) and/or additional thermal losses.

Stage 3—

The spectral outputs of all of the prototypes in stage 3 changed considerably, with numerous peaks developing throughout the previously established continuum in stage 2).

Figure 21C:
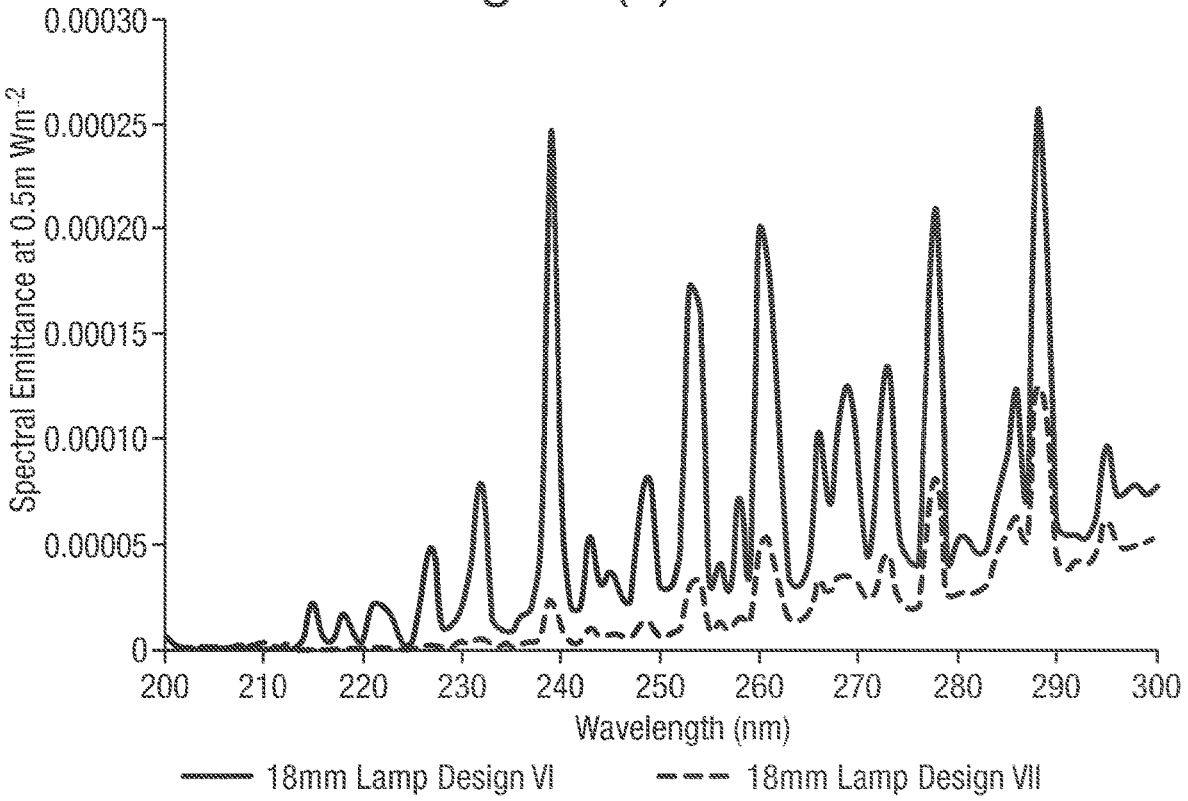

FIG. 21*c* shows the mean spectral output of 18 mm diameter prototype lamps of design VI and VII.

Figure 21D:
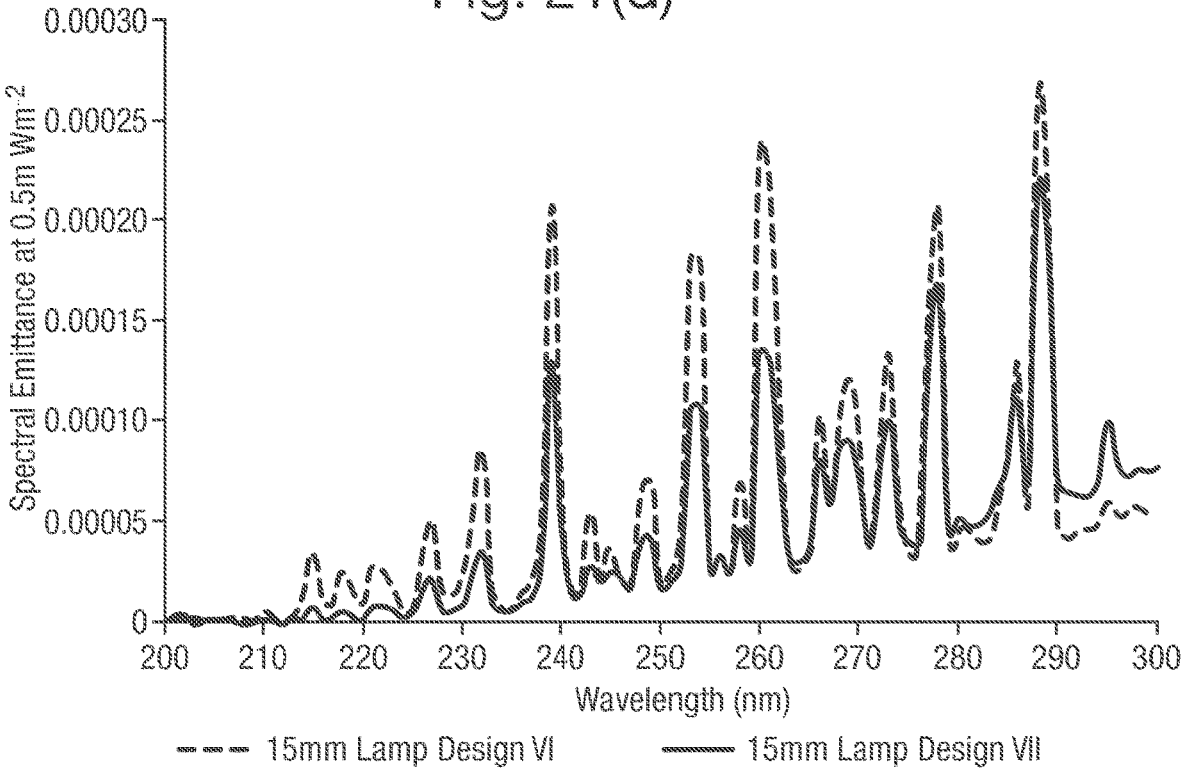

FIG. 21*d* shows the mean spectral output of 15 mm diameter prototype lamps of design VI and VII.

Both 15 mm and 18 mm lamps with design VI show a small but increased output below 220 nm however this is not the case with the 18 mm lamps. In fact in contrast to the proposed increase in lamp efficiency with Sb as a dopant the prototypes produced in stage 3 are lower than that of stage 2.

The lamp design VI for both 15 mm and 18 mm lamps was based on one-fifth of the lamp fillings for lamp VII however minimal change in voltage was measured especially for the 15 mm lamps. This indicates that the Te in the gas phase is saturated, however it appears I continues to enter the gas phase. This can be seen in the transition from the straight stable arc with a low visible output and no gas pockets to that of the final often turbulent lamp (as described in results stage 2). This was most clearly demonstrated in lamp 18 mm VII C shown in FIG. 19*b* which transitioned to a raised upper arc with a dark lower section forming from gas pockets to encompass the bottom half of the lamp. During this transition the lamp voltage increased by one-third, suggesting that I was entering the gas phase and is the cause of the undesirable lamp characteristics after lamp warm up. The physical changes were even clearer with lamp 15 mm VIA (FIG. 19*c*) which displayed a minimal visible output during lamp warm and a straight arc later transforming into a discharge with a high visible output yet noticeably less turbulence and 'gas pocket' collection around the electrodes. Since lamp design VI was designed with a reduced lamp filling and shows the same response for both 15 mm and 18 mm lamps, it suggests that reducing the amount of lamp filling particularly that of the iodide contribution is likely to increase UV output.

Discussion

When considering the overall results from design stages 1, 2 and 3 which at best has produced approximately one-tenth of the germicidal output compared to their Hg counterparts, and for the most part produced lamp arcs with erratic properties, particularly when close to the electrodes, it is clear that the design concept is far from being ready for production. However the research has enabled key theoretical design features of the lamp concept in its current state to have been verified. In addition the likely causes of the performance limitations of the prototypes were also identified and suggestions made as to how these can be addressed.

The prototypes lamps all produced a sustained high pressure plasma discharge produced an arc without the need for Hg as a filling. The lamps also produced a spectral continuum in the desired 200-300 nm spectral region and the lamp physical structure remained intact in all prototypes. These findings are not only novel but are critical characteristics of any future lamp to improve the performance of high UV density radiation sources. The challenge is how can the germicidal efficiency be increased and arc discharge stabilised, both of which have the same root cause.

The spectral output produced from the second set of prototypes displayed in FIG. 21*a* and FIG. 21*b* had a relatively smooth continuum from 220 nm to 300 nm with a small number of spectral peaks, displaying some similarity to that presented by Turner (1994). The data from Turner (1994) (which peaks at approximately 575 nm) is not provided below 375 nm to make a direct comparison, however the similarities in continuums are reflective of a high pressure discharge whereby the increased photon atom collisions shift the spectrum to lower energy emissions, i.e. visible output. Therefore the spectral information implies that the quantities of lamp fillings are too high for an optimised UV output; this was confirmed by lamp design VI with reduced fillings that not only maintained lamp voltage but also produced higher germicidal efficiencies compared to lamp design VII (containing increase amounts of lamp fillings). The implications of both voltage measurements and spectral output are that to increase lamp functionality a decrease in lamp fillings is required; the point at which spectral efficiency is optimised and its resulting voltage density (i.e. V cm-1) will be one of the two key aspects to determine the ultimate functional effectiveness of this proposed lamp development approach going forward.

A key question was the halide stability above 600° C., specifically whether the reversible reaction between the formation and decomposition of TeI2 (2TeI2(g)⇌Te2(g)+2I2(g)) would either produce arc instability from I2 or condensation of Te. The inferred saturation of lamp filling suggests that within the plasma capacity for Te in the gas phase, condensation did not appear to be occurring, or if so, not to the detriment of the functionality of the lamp. In contrast I2 did appear to affect the stability of the arc and consequently the impedance of the plasma. This was supported by lamp design VI and VII which had lower outputs with Sb as a dopant and transitioned into a turbulent arc. This was due to the additional 1 from SbI3 which created increased turbulence near the electrodes and in the case of lamp 18 mm VII this extended the full underside of the arc. This would ordinarily be in itself a major design limitation due to the inability to maintain a halogen cycle however in this case two factors suggest that this is not the case. The first is the functional HP plasma even with the use of non-stoichiometric proportions of Te:I as lamp fillings. The second is the almost ideal characteristics of the lamp arcs during the majority of the lamp warm-up phases (Section 7.3.4). The capacity to be able to reduce the amount of I used to the point where it has little to no adverse effect on the arc stability and output above and beyond forming and maintaining the plasma will be critical on improving the performance of the lamp. The arc displayed during the warm-up phase, and intended to be reproduced permanently after lamp warm up with reduced ratios of 1 and reduced overall lamp fillings, displayed no visible turbulence and a minimal visible output (FIG. 19*c*). The challenge will be balancing the amount of lamp filling added in halide form so that a plasma can form (i.e. the lamp will strike) by adding enough halide, whilst the filling quantity being low enough so that it will not impede lamp stability and output during lamp operation. All of the prototypes which did strike got to full running power (not including the transition into the turbulent stage) in approximately one to two minutes, a similar timeframe to that of a Hg HP lamp making system design allocations (e.g. duty/standby requirements) the same as that for HP lamps currently in use (e.g. medium pressure lamps).

The description of the two key current limitations and potential methods to address them for core functionality have been discussed, however to develop such a lamp for the commercial market will involve a number of additional development steps. This will likely include optimisation of the electrical lamp driver which may require optimisation of electrical frequency but will almost certainly require a configuration providing a higher strike voltage. The lamp strike voltage could be reduced with the use of a 'penning gas' replacing argon with a dual gas combination with differing ionization levels leading to a greater production of ions reducing the voltage required to strike the lamp. Conversely the use of an increased buffer gas pressure to increase the lamp impedance could be applied if the optimal pressure based purely on the Te lamp fillings is not high enough to achieve a suitable V cm-1 value (albeit with the consequence of increasing the strike voltage). Ultimately a number of subtle design iterations will be required following fundamental plasma improvements to produce a lamp to meet a design specification based upon market requirements.

The production of a lamp based upon a halide filling will require additional control in the manufacturing process due to their hygroscopic nature, however since they are currently used as additives to Hg based lamps with appropriate training and equipment this will easily mitigated. Te is industrially available for production (albeit for this investigation TeI4 was significantly harder to locate than elemental Te) however in a high purity form it is more expensive than Hg with example costs of Te being £3.78/g and Hg £1.26/g, (with Te costs based on 500 g 99.9999+% purity; Hg costs based on 250 g 99.999995% purity), which in the context of this study for a 18 mm ID Te lamp (Lamp 5 requiring 150 mg of Te) and 18 mm ID Hg lamp (lamp requiring 40 mg of Hg) would cost £0.57 and £0.05 respectively. This is based on the amount of fillings used during testing which as per the recommendations is likely to reduce with further development stages. Although the relative cost of Te is significantly higher than Hg, the cost per lamp is very low for both lamp fillings in respective of other lamp component costs e.g. the cost of quartz for both 18 mm diameter lamp examples being £13.00. The availability and cost of Te as a primary filling has practical promise.

The development stages presented in this work should enable what is currently a unique and novel plasma concept enabling a Hg-free production of UV radiation to that of high efficiency germicidal lamp for commercial applications. The upcoming ban (Minamata Convention on Mercury) on the use of Hg in a large number of products including visible lighting by 2020 including import and exports (excluding products where no alternative is available e.g. water disinfection) suggests a clear environmental motivation to reduce or remove the wide application of mercury. The potential increase in production costs caused by import/export restrictions could in conjunction with environmental factors drive the need for a Hg-free alternative and the development of LED's and DBD's in the low energy density range. Whether this is or will become a further driver re-emphasises the potential benefit of the proof-of-concept Te-based UV radiation source, which if further developed could have significant and far-reaching effects on the industry.

Further Developments

To address the suggestions from the conclusions from the initial research a further set of prototype lamps were produced (9 mm ID, 190 mm Arc Length and 2 mm Wall Thickness). The filling details of each lamp are in the table below, spectral outputs of the lamps in the graphs following with key outcomes stated below:

- Confirmation that a stoichiometric ratio 1:2 (Te:I) for lamp fillings does enable a stable arc and plasma to be formed
- Antimony can be used as an additional additive in the lamp fillings whilst a maintaining a stable arc and plasma The most efficient lamp fillings was that of Tellurium and iodine only although this could be optimised in the future

TABLE A

| Lamp Name (9 mm ID) | Hg (mg) | Te (mg) | $TeI_4$ (mg) | Sb (mg) |
|---|---|---|---|---|
| Lamp 1 | — | 4 | 20 | — |
| Lamp 2 | — | 2 | 10 | — |
| Lamp 3 | — | 4 | 4 | — |
| Lamp 4 | — | 4 | 4 | 1 |
| Lamp 5 | — | 2 | 10 | 1 |

Figure 22A:
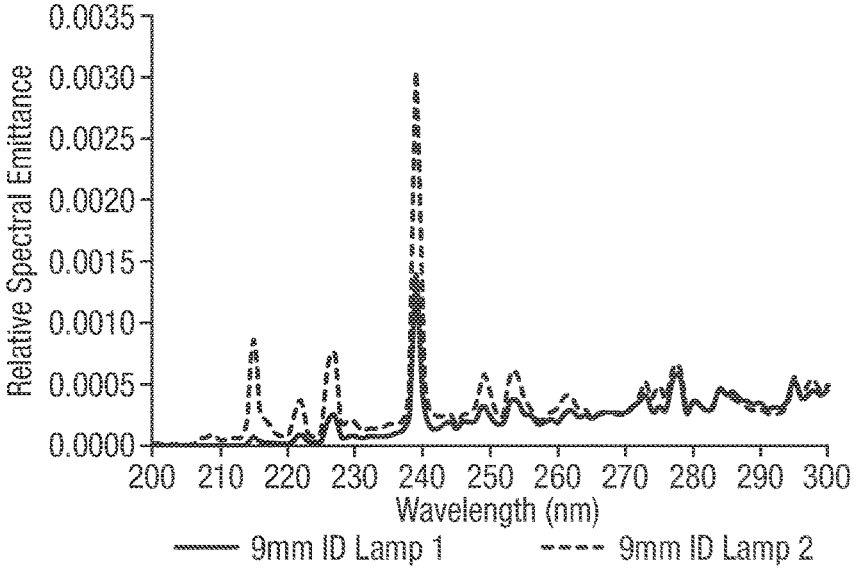
FIGS. 22(*a*), 22(*b*) and 22(*c*) show the mean spectral output of further prototype lamps.
Figure 22B:
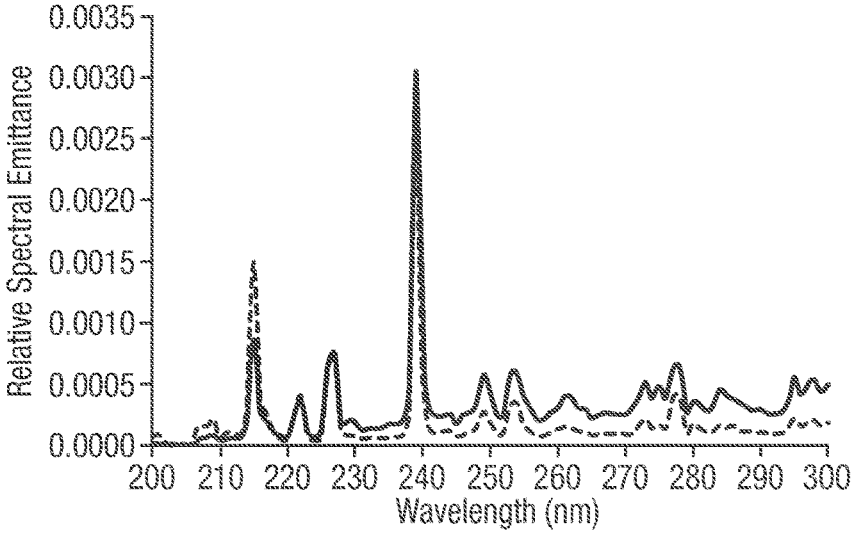
Figure 22C:
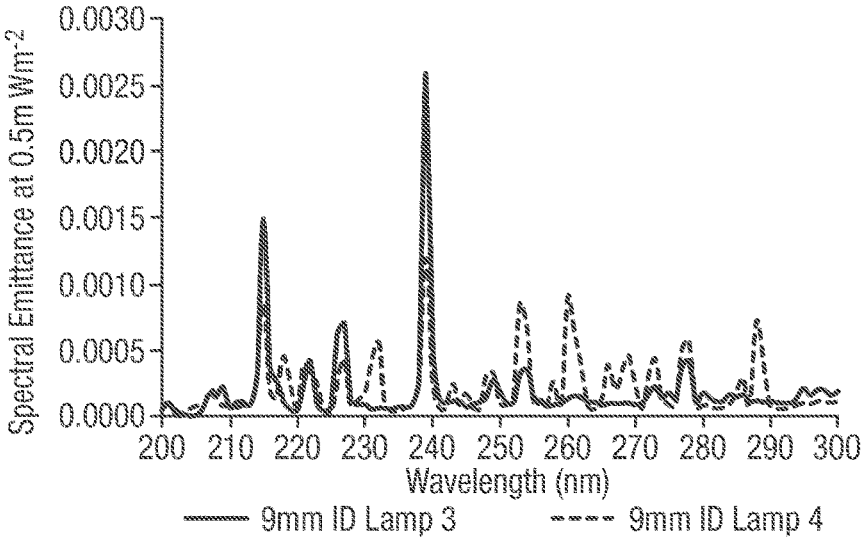

FIG. 22 show the mean spectral output of further prototype lamps, where: FIG. 22*a* shows the mean spectral output of Lamp 1 and Lamp 2 (Lamp 1: Te: 4 mg; TeI4: 20 mg; Lamp 2: Te: 2 mg; TeI4: 10 mg);

FIG. 22*b* shows the mean spectral output of Lamp 2 and Lamp 3 (Lamp 2: Te: 2 mg; $TeI_4$: 10 mg; Lamp 3: Te: 4 mg; $TeI_4$: 4 mg);

FIG. 22*c* shows the mean spectral output of Lamp 3 and Lamp 4 (Lamp 3: Te: 4 mg; $TeI_4$: 4 mg; Lamp 4: Te: 4 mg; $TeI_4$: 4 mg; Sb: 1 mg).

Figure 23A:
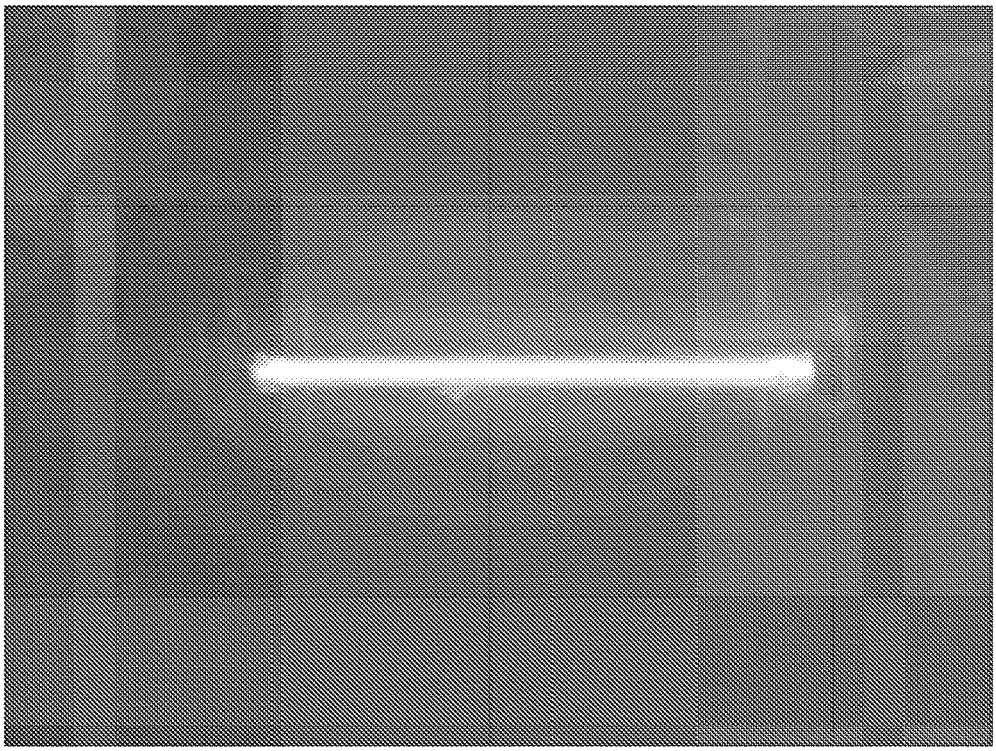
FIGS. 23(*a*) and 23(*b*) shows Lamp 5 in operation.
Figure 23B:
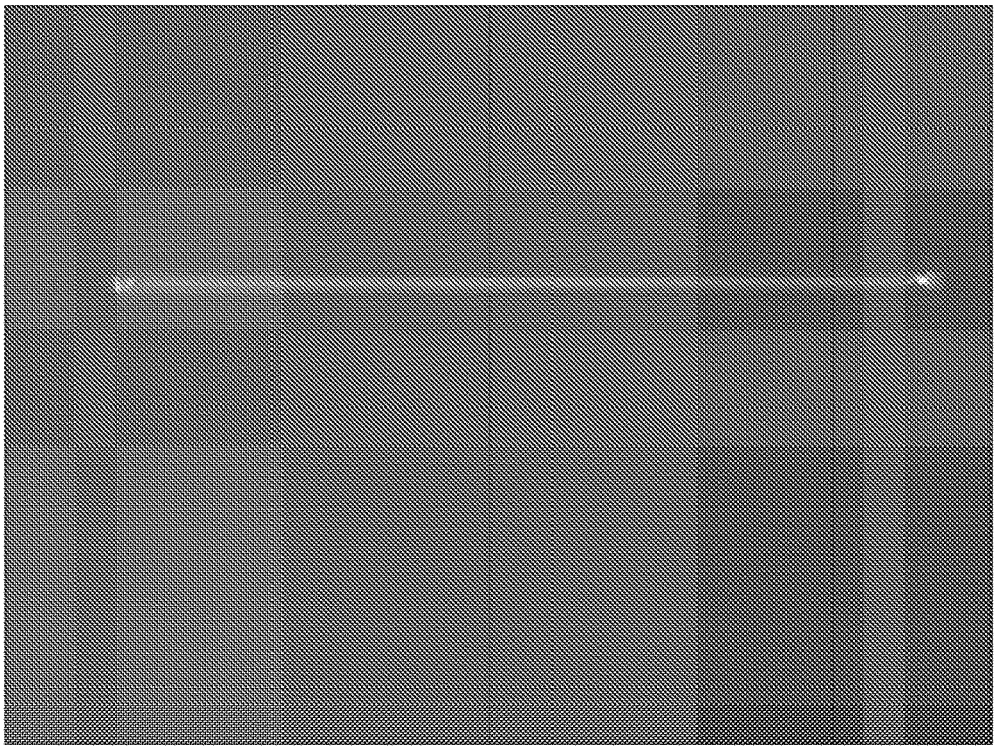

FIG. 23 shows Lamp 5 in operation.

TABLE B

| Lamp Details | Mean Voltage (V) | Mean Current (A) | Mean Power (W) | Germ A % | Comments |
|---|---|---|---|---|---|
| Hg Lamp A | 249 | 4.64 | 1153 | 10.54 | The arc on the right electrode (from the viewer's position) is raised above the centre line of the lamp and may be indicative of nearing the transition to internal turbulence and raising of arc. |
| Hg Lamp B | 236 | 4.78 | 1126 | 10.68 | The lamp ran smoothly. |
| Hg Lamp C | 244 | 4.69 | 1142 | 10.76 | The lamp ran smoothly. |
| Lamp 1A | 138 | 8.68 | 1111 | 1.99 | The lamp ran smoothly. |
| Lamp 1B | 137 | 8.90 | 1129 | — | The lamp struck easily and ran well producing a clear arc throughout main body. However, small amount of turbulence visible around electrodes. |
| Lamp 1C | 144 | 8.40 | 1128 | 1.54 | The lamp ran smoothly with black mark around the stem resulted from de-stemming process. |
| Lamp 1D | 135 | 9.18 | 1133 | 1.42 | The lamp ran smoothly with black mark around the stem resulted from de-stemming process. |
| Lamp 2A | 124 | 10.51 | 1126 | — | The lamp struck easily and ran well producing a clear arc throughout main body. The right arc (from the viewer's position) is raised slightly higher than would be desired from the end of right electrodes, but it was perfect throughout the arc. |
| Lamp 2B | — | — | — | — | The lamp failed to strike due to production errors. |
| Lamp 2C | — | — | — | — | The lamp failed to strike due to production errors. |
| Lamp 2D | — | — | — | — | The lamp failed to strike due to production errors. |
| Lamp 2E | — | — | — | — | Electrical measurements were not able to be taken and so data is not provided. However spectral data was obtained because the lamp still ran successfully. |
| Lamp 2F | — | — | — | — | The lamp failed to strike due to production errors. |
| Lamp 2G | 125 | 10.43 | 1117 | 2.13 | The lamp ran smoothly. |
| Lamp 2H | 125 | 10.50 | 1090 | 2.39 | The lamp ran smoothly. |
| Lamp 3A | — | — | — | — | The lamp failed to strike due to production errors. |
| Lamp 3B | 119 | 11.79 | 1165 | — | The lamp struck easily and ran well producing a clear arc central within the lamp body. |
| Lamp 3C | 115 | 11.84 | 1162 | 1.02 | The lamp ran smoothly. |
| Lamp 3D | 119 | 11.57 | 1159 | 0.91 | The lamp ran smoothly. |
| Lamp 4A | 123 | 11.12 | 1121 | 1.51 | The lamp ran smoothly. |
| Lamp 4B | 122 | 11.04 | 1109 | 1.51 | The lamp ran smoothly. |
| Lamp 4C | 121 | 11.10 | 1107 | 1.07 | The lamp ran smoothly. |
| Lamp 4D | 128 | 10.17 | 1102 | 1.58 | The lamp ran smoothly. |
| Lamp 5A | — | — | — | — | The lamp failed to strike due to production errors. |
| Lamp 5B | 148 | 8.93 | 1295 | 1.40 | The lamp ran smoothly. |
| Lamp 50 | 153 | 9.70 | 1424 | 1.30 | The lamp ran smoothly. |
| Lamp 5D | 147 | 9.00 | 1297 | 1.33 | The lamp ran smoothly. |

CONCLUSION

In summary, a novel proof-of-concept Hg-free plasma enabling a high pressure UV discharge was produced. The germicidal efficiency of prototype designs were significantly lower than that of the Hg equivalents, however two fundamental limitations were identified as being the primary causes: excessively loaded lamps with plasma saturation and an iodine content greater than a stable UV-efficient discharge can contain. The study critically revealed that non-stoichiometric quantities of Te to I can be used whilst still producing functional lamp plasma that produces desirable electrical characteristics and a stable arc. With increasing environmental and economic drivers to produce a Hg-free, high efficiency and high power density lamp, the following recommendations are proposed to further develop the presented proof-of-concept into an applicable lamp for the water industry:

1. Develop a range of lamps with reduced Te lamp fillings until an optimised filling is produced for both spectral output and power density;
2. In conjunction with point 1 develop a further range of lamp fillings with a reduced iodine content that enables a functional plasma whilst having a minimal impact on arc stability and germicidal efficiency;
3. Following the completion of points 1 and 2 optimise the lamp driver, buffer gas and additional dopants to enable an efficient lamp for practical use.

The results presented suggest a possible alternative to current Hg-based lamps as a source of UVC radiation. Although the results to-date provided approximately 1/10th the efficiency of current Hg lamp technology, this has been achieved without the use of Hg, with less toxic lamp fillings. It is anticipated that following additional rounds of improvements that the lamp efficiency will improve significantly and could increase beyond that of a conventional Hg lamp. If the efficiency of the lamp is increased above that of the conventional Hg lamp then a reduction in whole life costs and direct and indirect carbon costs will occur.

Excluding reactor design optimisation (e.g. hydraulic optimisation, lamp positioning etc.) the reactor efficiency will be determined by the efficiency of the lamp(s) in use. The findings provided are encouraging, offering the potential to not only provide the generation of UV radiation without Hg but also with a spectral output that is dominated by ER above 240 nm, ideal for the spectral application in all three validation protocols. Further development is required prior to production, however the unique selling point of the lamp being Hg-free and the potential of increased efficiency within currently applied technology (e.g. lamp geometries and lamp driver) makes a strong case for further investment.

Features of the present invention include:

- relatively low internal design pressure specifically to produce UV radiation or radiation below 400 nm
- use of a reduced ratio of Iodine to produce a stable arc and lamp plasma in a cylindrical tube
- use of a reduced amount of iodine for the production of UV radiation rather than excess iodine which may stimulate a visible emission It will be understood that the invention has been described above purely by way of example, and modifications of detail can be made within the scope of the invention.

Reference numerals appearing in any claims are by way of illustration only and shall have no limiting effect on the scope of the claims.

What is claimed is:

1. A mercury-free high-pressure metal-halide ultraviolet gas-discharge lamp comprising a primary filling of tellurium and a secondary filling of antimony.

2. The gas-discharge lamp according to claim 1, wherein the primary filling comprises halogen of metal-halide with iodine.

3. The gas-discharge lamp according to claim 2, wherein in use the primary filling is-comprises TeI2 and the secondary filling comprises SbI3.

4. The gas-discharge lamp according to claim 3, wherein the non-stoichiometric ratio comprises a reduced iodine content.

5. The gas-discharge lamp according to claim 2 or 3, wherein the ratio of iodine to tellurium is non-stoichiometric.

6. The gas-discharge lamp according to claim 5, wherein the ratio of iodine to tellurium is no greater than 2:1.

7. The gas-discharge lamp according to claim 6, wherein the ratio of iodine to tellurium is no greater than 1.5.

8. The gas-discharge lamp according to any preceding claim, wherein the lamp output comprises electromagnetic radiation of wavelength in the range 200-300 nm.

9. The gas-discharge lamp according to claim 8, wherein the ratio of iodine to tellurium is less than 1.0.

10. The method of filling a gas-discharge lamp with a primary filling and a secondary filling in accordance with any preceding claim.

* * * * *